US007086242B2

(12) United States Patent
Maeda

(10) Patent No.: US 7,086,242 B2
(45) Date of Patent: Aug. 8, 2006

(54) DEHUMIDIFYING AIR-CONDITIONING APPARATUS

(75) Inventor: Kensaku Maeda, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/483,081

(22) PCT Filed: Jul. 15, 2002

(86) PCT No.: PCT/JP02/07159

§ 371 (c)(1),
(2), (4) Date: May 26, 2004

(87) PCT Pub. No.: WO03/006890

PCT Pub. Date: Jan. 23, 2003

(65) Prior Publication Data

US 2004/0206094 A1 Oct. 21, 2004

(30) Foreign Application Priority Data

Jul. 13, 2001 (JP) ..... 2001-214101

(51) Int. Cl.
*F28B 9/00* (2006.01)

(52) U.S. Cl. ..... 62/172; 62/205

(58) Field of Classification Search ..... 62/79, 62/87, 93, 172, 277, 401, 402, 498, 524–527, 62/198, 205; 236/92 B, 29 B
See application file for complete search history.

(56) References Cited

U.S. PATENT DOCUMENTS 4,428,205 A * 1/1984 Doderer ..... 62/93

(Continued)

FOREIGN PATENT DOCUMENTS

JP 5-231731 9/1993

(Continued)

*Primary Examiner*—Mohammad M. Ali
(74) *Attorney, Agent, or Firm*—Westerman, Hattori, Daniels & Adrian, LLP.

(57) ABSTRACT

A dehumidifying air-conditioning apparatus comprises a pressurizer (4) for raising a pressure of a refrigerant, a condenser (5) for condensing the refrigerant to heat a high-temperature heat source fluid, and an evaporator (1) for evaporating the refrigerant to cool process air to a temperature lower than its dew point. A first heat exchanging portion (21) is disposed in a refrigerant path between the condenser (5) and the evaporator (1) for evaporating the refrigerant under an intermediate pressure between the condensing pressure of the condenser (5) and the evaporating pressure of the evaporator (1) to cool the process air by evaporation of the refrigerant under the intermediate pressure. A second heat exchanging portion (22) is disposed in the refrigerant path between the condenser (5) and the evaporator (1) for condensing the refrigerant under an intermediate pressure between the condensing pressure of the condenser (5) and the evaporating pressure of the evaporator (1) to heat the process air by condensation of the refrigerant under the intermediate pressure. The first heat exchanging portion (21), the evaporator (1), and the second heat exchanging portion (22) are connected in the order named by paths (30, 31, 32, 33, 34). A first restriction (1) is disposed on the refrigerant path (42) at the upstream side of the heat exchanging portion (21). A second restriction (12) is disposed on the refrigerant path (43) at the downstream side of the heat exchanging portion (22). The throttling effect of the first restriction (11) is larger than that of the second restriction (12).

18 Claims, 16 Drawing Sheets

U.S. PATENT DOCUMENTS

| | | | | | |
|---|---|---|---|---|---|
| 5,031,411 | A | | 7/1991 | Gehring et al. | |
| 5,036,672 | A | * | 8/1991 | Rottmann | 62/651 |
| 5,761,923 | A | * | 6/1998 | Maeda | 62/271 |
| 5,816,065 | A | * | 10/1998 | Maeda | 62/271 |
| 5,966,955 | A | * | 10/1999 | Maeda | 62/238.3 |
| 6,029,467 | A | * | 2/2000 | Moratalla | 62/271 |
| 6,247,323 | B1 | * | 6/2001 | Maeda | 62/271 |
| 6,311,511 | B1 | * | 11/2001 | Maeda | 62/271 |
| 6,318,106 | B1 | * | 11/2001 | Maeda | 62/271 |
| 6,321,547 | B1 | * | 11/2001 | Kidwell | 62/209 |
| 6,393,850 | B1 | * | 5/2002 | Vanderstraeten | 62/196.3 |
| 6,442,951 | B1 | * | 9/2002 | Maeda et al. | 62/94 |

FOREIGN PATENT DOCUMENTS

| | | | |
|---|---|---|---|
| JP | 8-68556 | | 3/1996 |
| JP | 11-132506 | A * | 5/1999 |
| JP | 2001-147032 | | 5/2001 |

* cited by examiner

DEHUMIDIFYING AIR-CONDITIONING APPARATUS

TECHNICAL FIELD

The present invention relates to a dehumidifying air-conditioning apparatus, and more particularly to a dehumidifying air-conditioning apparatus which has a heat pump with a high coefficient of performance (COP) and a high moisture removal per energy consumption.

BACKGROUND ART

FIG. 15 is a flow diagram of a conventional air-conditioning system. As shown in FIG. 15, there has heretofore been available a dehumidifying air-conditioning apparatus having a compressor 201 for compressing a refrigerant, a condenser 202 for condensing the compressed refrigerant with outside air OA, an evaporator 204 for depressurizing the condensed refrigerant with an expansion valve 203 and evaporating the refrigerant to cool process air from an air-conditioned space 100 to a temperature lower than its dew point, and a reheater 205 for reheating the process air, which has been cooled to a temperature lower than its dew point, at the downstream side of the condenser 202 with the refrigerant upstream of the expansion valve 203. With the illustrated dehumidifying air-conditioning apparatus, a heat pump HP is constituted by the compressor 201, the condenser 202, the reheater 205, the expansion valve 203, and the evaporator 204. The heat pump HP pumps heat from the process air which flows through the evaporator 204 into the outside air OA which flows through the condenser 202.

FIG. 16 is a Mollier diagram in the case where HFC134a is used as the refrigerant in the conventional dehumidifying air-conditioning apparatus. In FIG. 16, a point "a" represents a state of the refrigerant evaporated by the evaporator 204, and the refrigerant is in the form of a saturated vapor. The refrigerant has a pressure of 0.34 MPa, a temperature of 5° C., and an enthalpy of 400.9 kJ/kg. A point b represents a state of the vapor drawn and compressed by the compressor 201, i.e., a state at the outlet port of the compressor 201. In the point b, the refrigerant is in the form of a superheated vapor.

The refrigerant vapor in the state represented by the point b is cooled in the condenser 202 and reaches a state represented by a point c in the Mollier diagram. In the point c, the refrigerant is in the form of a saturated vapor and has a pressure of 0.94 MPa and a temperature of 38° C. Under this pressure, the refrigerant is cooled and condensed to reach a state represented by a point d. In the point d, the refrigerant is in the form of a saturated liquid and has the same pressure and temperature as those in the point c. The saturated liquid has an enthalpy of 250.5 kJ/kg.

The refrigerant liquid is depressurized by the expansion valve 203 to a saturation pressure of 0.34 MPa at a temperature of 5° C. and reaches a state represented by the point e. The refrigerant at the point e is delivered as a mixture of the refrigerant liquid and the vapor at a temperature of 5° C. to the evaporator 204, in which the mixture removes heat from process air and is evaporated to reach a state of the saturated vapor, which is represented by the point a in the Mollier diagram. The saturated vapor is drawn into the compressor 201 again, and the above cycle is repeated.

FIG. 17 is a psychrometric chart showing an air-conditioning cycle in the conventional dehumidifying air-conditioning apparatus. In FIG. 17, the alphabetical letters K, L, M correspond to states in paths indicated by the encircled letters in FIG. 15. As shown in FIG. 17, in the conventional dehumidifying air-conditioning apparatus, air (in a state K) from the air-conditioned space 100 is cooled to a temperature lower than its dew point to lower the dry bulb temperature thereof and lower the absolute humidity thereof, and reaches a state L. The state L is on a saturation curve in the psychrometric chart. The air in the state L is reheated by the reheater 205 to increase the dry bulb temperature thereof and keep the absolute humidity thereof constant, and reaches a state M. Then, the air is supplied to the air-conditioned space 100. The state M is lower in both of absolute humidity and dry bulb temperature than the state K.

With the conventional dehumidifying air-conditioning apparatus described above, since it is necessary to considerably cool the air to its dew point, about 50% of the cooling effect of the evaporator in the heat pump is consumed to remove a sensible heat load from the air, so that the moisture removal (the dehumidifying performance) per electric power consumption is low. If a single-stage compressor is used as the compressor in the heat pump, then it produces a one-stage compression-type refrigerating cycle, resulting in a low coefficient of performance (COP) and a large amount of electric power consumed per amount of moisture removal.

DISCLOSURE OF INVENTION

The present invention has been made in view of the above drawbacks. It is therefore an object of the present invention to provide a dehumidifying air-conditioning apparatus which has a heat pump with a high coefficient of performance (COP) and a high moisture removal per energy consumption.

In order to attain the above object, according to a first aspect of the present invention, there is provided a dehumidifying air-conditioning apparatus comprising: a pressurizer for raising a pressure of a refrigerant; a condenser for condensing the refrigerant to heat a high-temperature heat source fluid; an evaporator for evaporating the refrigerant to cool process air to a temperature lower than its dew point; a first heat exchanging portion disposed in a refrigerant path between the condenser and the evaporator for evaporating the refrigerant under an intermediate pressure between the condensing pressure of the condenser and the evaporating pressure of the evaporator to cool the process air by evaporation of the refrigerant under the intermediate pressure; a second heat exchanging portion disposed in the refrigerant path between the condenser and the evaporator for condensing the refrigerant under an intermediate pressure between the condensing pressure of the condenser and the evaporating pressure of the evaporator to heat the process air by condensation of the refrigerant under the intermediate pressure; a process air path connecting the first heat exchanging portion, the evaporator, and the second heat exchanging portion in the order named; a first restriction disposed on the refrigerant path at the upstream side of the heat exchanging portion; and a second restriction disposed on the refrigerant path at the downstream side of the heat exchanging portion; wherein the throttling effect of the first restriction is larger than that of the second restriction.

According to a second aspect of the present invention, there is provided a dehumidifying air-conditioning apparatus comprising: a pressurizer for raising a pressure of a refrigerant; a condenser for condensing the refrigerant to heat a high-temperature heat source fluid; an evaporator for evaporating the refrigerant to cool process air to a temperature lower than its dew point; a refrigerant path branched into a plurality of branched refrigerant paths between the condenser and the evaporator; a first heat exchanging portion disposed in the branched refrigerant path between the condenser and the evaporator for evaporating the refrigerant under an intermediate pressure between the condensing pressure of the condenser and the evaporating pressure of the evaporator to cool the process air by evaporation of the refrigerant under the intermediate pressure; a second heat exchanging portion disposed in the branched refrigerant path between the condenser and the evaporator for condensing the refrigerant under an intermediate pressure between the condensing pressure of the condenser and the evaporating pressure of the evaporator to heat the process air by condensation of the refrigerant under the intermediate pressure; a process air path connecting the first heat exchanging portion, the evaporator, and the second heat exchanging portion in the order named; a first restriction disposed on the refrigerant path at the upstream side of the heat exchanging portion; and a second restriction disposed on the refrigerant path at the downstream side of the heat exchanging portion; wherein the throttling effect of the first restriction is larger than that of the second restriction.

In this case, at least one of the first restriction and the second restriction may comprise an orifice, a capillary tube, and an expansion valve.

With the above arrangement, the process air can be precooled in the first heat exchanging portion prior to cooling in the evaporator. The process air can be heated in the second heat exchanging portion after process air is cooled to a temperature lower than its dew point by the evaporator with use of the heat in precooling. Therefore, it is possible to provide a dehumidifying air-conditioning apparatus which consumes a small amount of energy per amount of moisture removal.

Further, since the throttling effect of the first restriction disposed on the refrigerant path at the upstream side of the heat exchanging portion is larger than that of the second restriction disposed on the refrigerant path at the downstream side of the heat exchanging portion, the refrigerant vapor is restrained from passing through the upstream first restriction, and hence it is possible to increase the cooling effect for cooling the process air in the first heat exchanging portion. Further, the refrigerant is restrained from being stagnated in the refrigerant path of the heat exchanging portion due to the downstream second restriction, and hence the efficiency of heat exchange is increased in the heat exchanging portion.

Further, according to the second aspect of the present invention, with the branched refrigerant paths, the operative temperature of the refrigerant can gradually be changed to achieve a high efficiency of heat exchange. When the high-temperature fluid is cooled, i.e., the heat exchanger is used for cooling the high-temperature fluid, the efficiency $\phi$ of heat exchange is defined by $$\phi=(TP1-TP2)/(TP1-TC1)$$

where the temperature of the high-temperature fluid at the inlet of the heat exchanger is represented by TP1, the temperature thereof at the outlet of the heat exchanger by TP2, the temperature of the low-temperature fluid at the inlet of the heat exchanger is represented by TC1, and the temperature thereof at the outlet of the heat exchanger by TC2. When the low-temperature fluid is to be heated, i.e., when the heat exchanger is used to heat the low-temperature fluid, the efficiency $\phi$ of heat exchange is defined by $$\phi=(TC2-TC1)/(TP1-TC1)$$

According to a third aspect of the present invention, there is provided a dehumidifying air-conditioning apparatus comprising: a pressurizer for raising a pressure of a refrigerant; a condenser for condensing the refrigerant to heat a high-temperature heat source fluid; an evaporator for evaporating the refrigerant to cool process air to a temperature lower than its dew point; a first heat exchanging portion disposed in a refrigerant path between the condenser and the evaporator for evaporating the refrigerant under an intermediate pressure between the condensing pressure of the condenser and the evaporating pressure of the evaporator to cool the process air by evaporation of the refrigerant under the intermediate pressure; a second heat exchanging portion disposed in the refrigerant path between the condenser and the evaporator for condensing the refrigerant under an intermediate pressure between the condensing pressure of the condenser and the evaporating pressure of the evaporator to heat the process air by condensation of the refrigerant under the intermediate pressure; a process air path connecting the first heat exchanging portion, the evaporator, and the second heat exchanging portion in the order named; a first restriction disposed on the refrigerant path at the upstream side of the heat exchanging portion; and a second restriction disposed on the refrigerant path at the downstream side of the heat exchanging portion; wherein the quality at the upstream side of the first restriction is smaller than the quality at the upstream side of the second restriction.

According to a preferred aspect of the present invention, the first restriction and the second restriction produce respective throttling effects in cooperation with each other. Typically, the restrictions produce the throttling effects in mechanical cooperation with each other. However, the restrictions may produce the throttling effects in electrical cooperation with each other.

According to a preferred aspect of the present invention, the first restriction and the second restriction are formed integrally with each other and actuated by a single actuator. In this case, the restrictions may have a mechanically integral structure.

According to a preferred aspect of the present invention, the first restriction and the second restriction have needle valve mechanisms.

The above and other objects, features, and advantages of the present invention will be apparent from the following description when taken in conjunction with the accompanying drawings which illustrates preferred embodiments of the present invention by way of example.

BEST MODE FOR CARRYING OUT THE INVENTION

Figure 1:
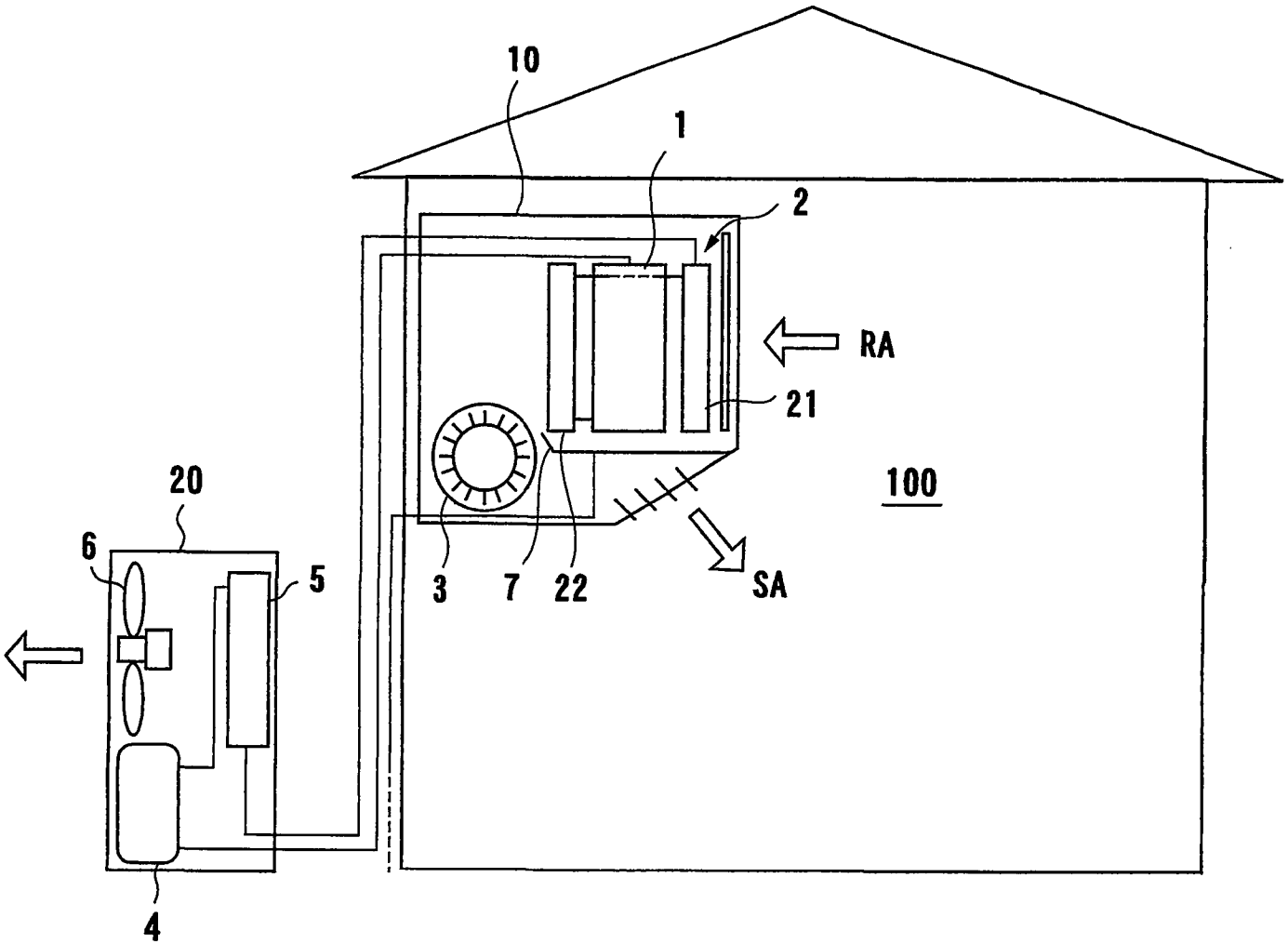
FIG. 1 is a schematic view showing a whole arrangement of an air-conditioning system according to an embodiment of the present invention.
Figure 2:
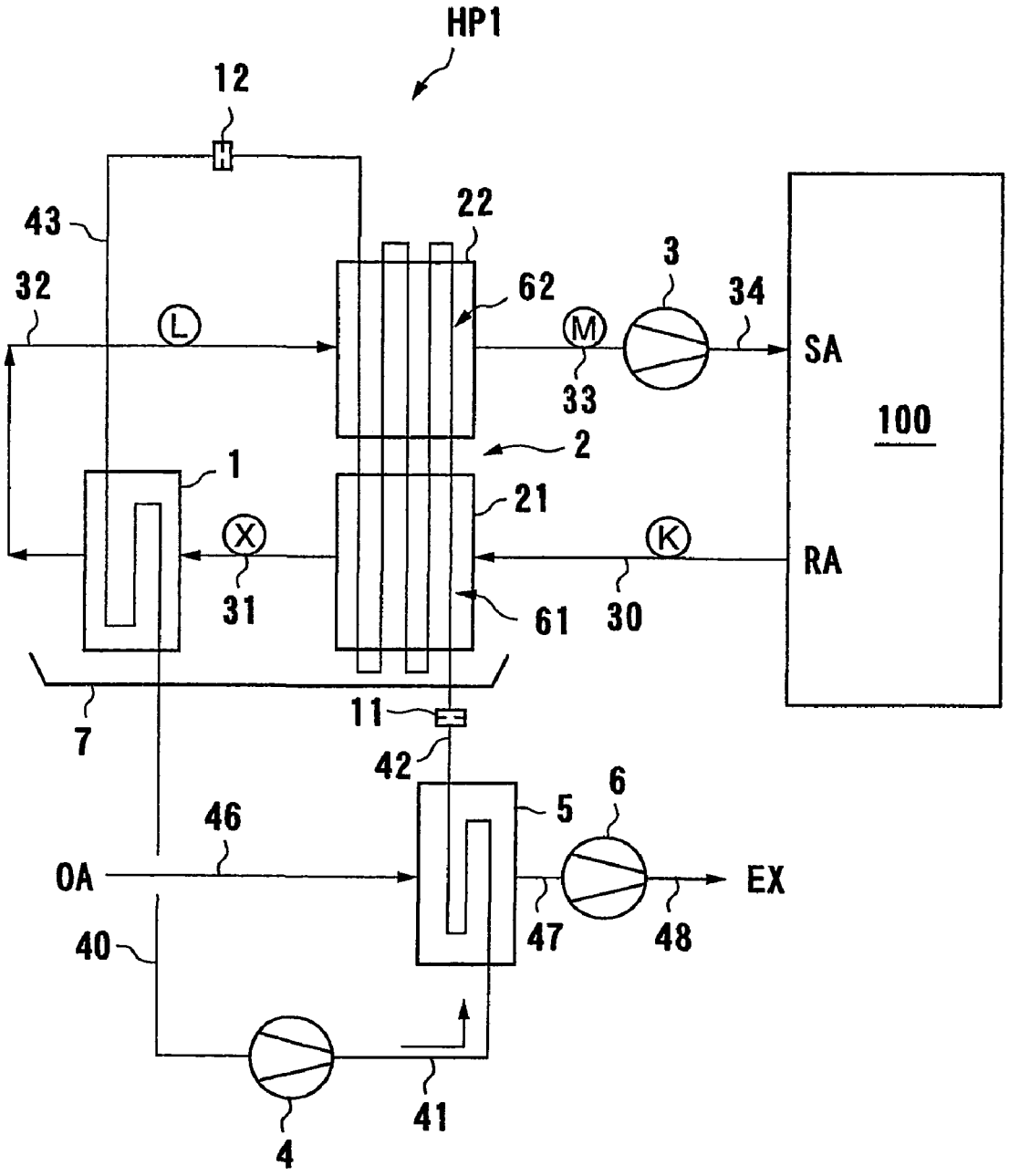
FIG. 2 is a flow diagram of a dehumidifying air-conditioning apparatus according to a first embodiment of the present invention.

A dehumidifying air-conditioning apparatus according to a first embodiment of the present invention will be described below with reference to FIGS. 1 through 6. FIG. 1 is a schematic view showing a whole arrangement of an air-conditioning system according to the present invention, and FIG. 2 is a flow diagram of a dehumidifying air-conditioning apparatus according to the first embodiment of the present invention. The dehumidifying air-conditioning apparatus in the present embodiment serves to cool air (process air) to a temperature lower than its dew point for dehumidifying the air. The dehumidifying air-conditioning apparatus includes a heat pump HP1 therein. The process air is lowered in humidity and supplied as the process air to an air-conditioned space 100 by the dehumidifying air-conditioning apparatus, for thereby maintaining a comfortable environment in the air-conditioned space 100.

As shown in FIG. 1, the dehumidifying air-conditioning apparatus mainly comprises an indoor unit 10 installed inside of the air-conditioned space 100 and an outdoor unit 20 installed outside of the air-conditioned space 100 (outdoor). The indoor unit 10 in the dehumidifying air-conditioning apparatus comprises a refrigerant evaporator 1 for evaporating a refrigerant, a heat exchanger 2 for exchanging heat between the refrigerant and the process air, and an air blower 3 for circulating the process air. The heat exchanger 2 performs heat exchange between process air flowing into the evaporator 1 and process air flowing out of the evaporator 1, indirectly with the refrigerant. The heat exchanger 2 has a first heat exchanging portion 21 for evaporating the refrigerant to cool the process air, and a second heat exchanging portion 22 for condensing the refrigerant to heat the process air. The outdoor unit 20 in the dehumidifying air-conditioning apparatus comprises a pressurizer (compressor) 4 for raising a pressure of the refrigerant, a refrigerant condenser 5 for cooling and condensing the refrigerant, and an air blower 6 for circulating the cooling air.

Process air paths, which are paths for circulating process air, include a path 30 connecting the air-conditioned space 100 and the first heat exchanging portion 21 in the heat exchanger 2, a path 31 connecting the first heat exchanging portion 21 and the evaporator 1, a path 32 connecting the evaporator 1 and the second heat exchanging portion 22 in the heat exchanger 2, a path 33 connecting the second heat exchanging portion 22 and the air blower 3, and a path 34 connecting the air blower 3 and the air-conditioned space 100. Thus, the first heat exchanging portion 21 in the heat exchanger 2, the evaporator 1, and the second heat exchanging portion 22 in the heat exchanger 2 are connected in the order named by the process air paths.

Refrigerant paths, which are paths for circulating the refrigerant, include a path 40 connecting the evaporator 1 and the compressor 4, a path 41 connecting the compressor 4 and the condenser 5, a path 42 connecting the condenser 5 and the heat exchanger 2, and a path 43 connecting the heat exchanger 2 and the evaporator 1. The refrigerant path in the heat exchanger 2 alternately extends through the first heat exchanging portion 21 and the second heat exchanging portion 22, respectively. An evaporating section 61 for evaporating the refrigerant to cool the process air which flows through the first heat exchanging portion 21 is provided in the first heat exchanging portion 21 of the heat exchanger 2. A condensing section 62 for condensing the refrigerant to heat (reheat) the process air which flows through the second heat exchanging portion 22 is provided in the second heat exchanging portion 22 of the heat exchanger 2.

An orifice (upstream orifice) 11 is disposed as a first restriction on the refrigerant path 42 at the upstream side of the first heat exchanging portion 21. An orifice (downstream orifice) 12 is disposed as a second restriction on the refrigerant path 43 at the downstream side of the second heat exchanging portion 22. The upstream orifice 11 has an opening area smaller than the downstream orifice 12. Therefore, the throttling effect (flow reducing effect) of the upstream orifice 11 is set to be larger than that of the downstream orifice 12.

Outside air OA is introduced as cooling air through the path 46 into the condenser 5. The outside air OA removes heat from the refrigerant which is condensed, and the heated outside air OA is drawn through the path 47 into the air blower 6, from which the air is discharged through the path 48 as exhaust air EX.

Figure 3:
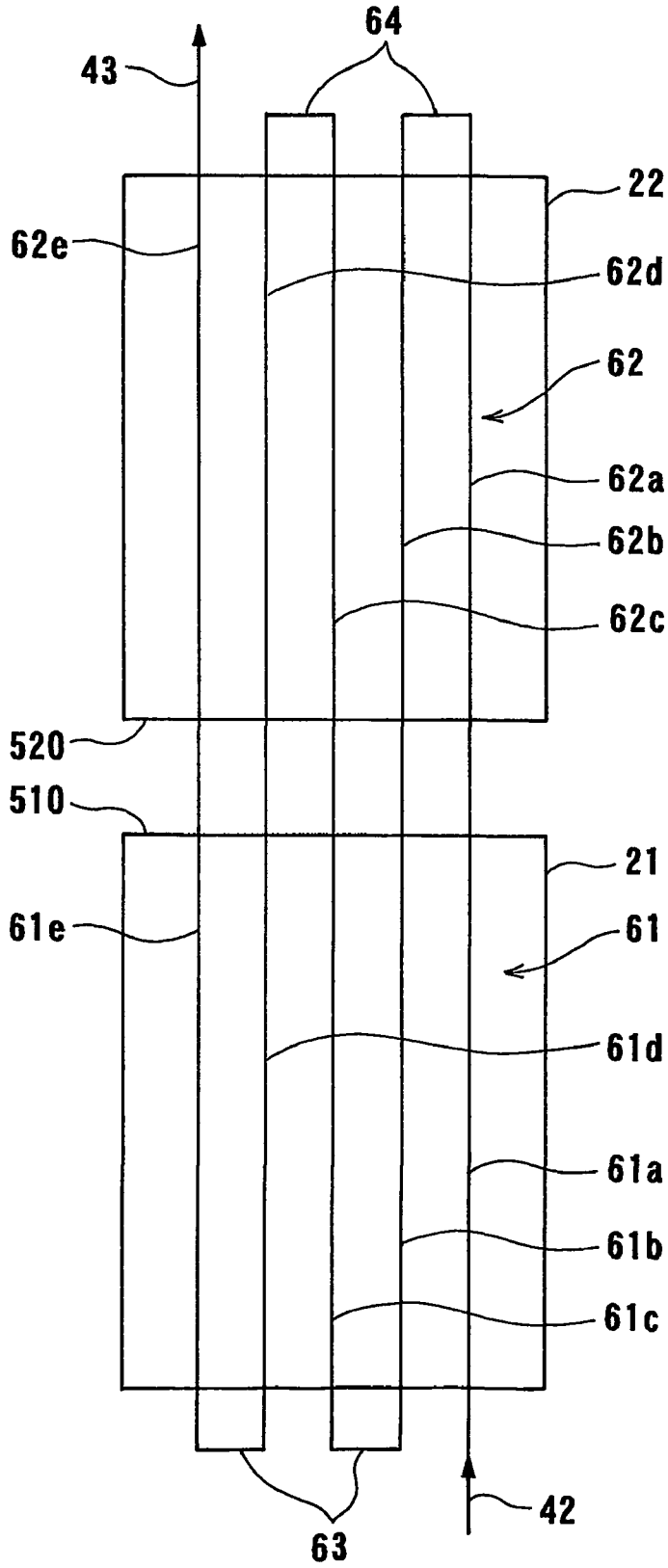
FIG. 3 is an enlarged view showing a refrigerant path in a heat exchanger of the dehumidifying air-conditioning apparatus shown in FIG. 2.

FIG. 3 is an enlarged view showing the refrigerant paths in the heat exchanger 2 of the dehumidifying air-conditioning apparatus shown in FIG. 2. The refrigerant path including the evaporating section 61 and the condensing section 62 extends through the first heat exchanging portion 21 and the second heat exchanging portion 22 in the heat exchanger 2, alternately and repeatedly. Specifically, as shown in FIG. 3, the refrigerant path in the heat exchanger 2 has an evaporating section 61*a*, a condensing section 62*a*, a condensing section 62*b*, an evaporating section 61*b*, an evaporating section 61*c*, a condensing section 62*c*, a condensing section 62*d*, an evaporating section 61*d*, an evaporating section 61*e*, and a condensing section 62*e*.

The heat exchanger 2 has the first heat exchanging portion 21 for allowing the process air before flowing through the evaporator 1 to pass therethrough, and the second heat exchanging portion 22 for allowing the process air after flowing through the evaporator 1 to pass therethrough. The first heat exchanging portion 21 and the second heat exchanging portion 22 form respective separate spaces, each in the form of a rectangular parallelepiped. The first heat exchanging portion 21 and the second heat exchanging portion 22, each in the form of a rectangular parallelepiped, have a plurality of substantially parallel heat exchange tubes as refrigerant passages in each of a plurality of planes which lie perpendicularly to the flow of the air. The first heat exchanging portion 21 and the second heat exchanging portion 22 have partition walls 510, 520 adjacent to each other, respectively. The heat exchange tubes extend through the two partition walls 510, 520.

The ends of the evaporating sections 61*b*, 61*c*, and the ends of the evaporating sections 61*d*, 61*e* are connected to each other by U tubes 63. Similarly, the ends of the condensing sections 62*a*, 62*b*, and the ends of the condensing sections 62*c*, 62*d* are connected to each other by U tubes 64. With the above arrangement, in the refrigerant path 42, the refrigerant flowing in one direction from the evaporating section 61*a* to the condensing section 62*a* is introduced into the condensing section 62*b* by the U tube 64. The refrigerant introduced into the condensing section 62*b* then flows into the evaporating section 61*b*, from which the refrigerant flows into the evaporating section 61*c* via the U tube 63 and further flows into the condensing section 62*c*. In this manner, the refrigerant passages in the heat exchanger 2 are provided as a group of meandering thin pipes. A group of meandering thin pipes pass through the first heat exchanging portion 21 and the second heat exchanging portion 22, and are held in alternate contact with the air which has a higher temperature and the air which has a lower temperature.

As shown in FIGS. 1 and 2, a drain pan 7 is provided in the indoor unit 10 of the dehumidifying air-conditioning apparatus. The drain pan 7 is preferably located below not only the evaporator 1, but also the heat exchanger 2. Particularly, the drain pan 7 is preferably disposed below the first heat exchanging portion 21 because the process air is mainly precooled in the first heat exchanging portion 21 and some moisture may possibly be condensed in the first heat exchanging portion 21.

The flow of the refrigerant in the devices will be described below with reference to FIGS. 2 and 3. A refrigerant vapor pressurized by the compressor 4 is introduced into the condenser 5 via the refrigerant pipe 41 connected to the discharge port of the compressor 4. The refrigerant vapor compressed by the compressor 4 is cooled and condensed by the outside air OA as cooling air.

The refrigerant liquid flowing out of the condenser 5 is depressurized by the orifice 11 provided on the refrigerant path 42 and expanded so as to be partly evaporated (flashed). The refrigerant which is a mixture of the liquid and the vapor reaches the evaporating section 61*a* in the first heat exchanging portion 21, where the refrigerant liquid flows so as to wet the inner wall surface of the tube in the evaporating section 61*a*. The refrigerant flows into the evaporating section 61*a* in the liquid phase. The refrigerant may be a refrigerant liquid which has been partly evaporated to slightly contain a vapor phase. While the refrigerant liquid is flowing through the evaporating section 61*a*, it is evaporated to cool (precool) the process air before flowing into the evaporator 1. The refrigerant itself is heated while increasing the vapor phase thereof.

As described above, the evaporating section 61*a* and the condensing section 62*a* are constructed as a continuous tube. Specifically, since the evaporating section 61*a* and the condensing section 62*a* are provided as an integral passage, the refrigerant vapor evaporated in the evaporating section 61*a* (and the refrigerant liquid which has not been evaporated) flows into the condensing section 62*a*, and heats (reheats) the process air, which has been cooled and dehumidified in the evaporator 1 and has a temperature lower than the process air in the evaporating section 61*a*. At this time, heat is removed from the evaporated refrigerant vapor itself, and while the evaporated refrigerant vapor in the vapor phase is condensed, the refrigerant flows into the next condensing section 62*b*. While the refrigerant is flowing through the condensing section 62*b*, heat is further removed from the refrigerant by the process air having a lower temperature, and the refrigerant in the vapor phase is further condensed.

The condensed refrigerant liquid flows into the next evaporating section 61*b* and the subsequent evaporating section 61*c* to cool (precool) the process air before flowing into the evaporator 1 in the same manner as described above. Thereafter, the refrigerant vapor flows into the condensing section 62*c* and the condensing section 62*d* to heat (reheat) the process air. In this manner, the refrigerant flows through the refrigerant path in the heat exchanger while changing in phase between the vapor phase and the liquid phase. Thus, heat is exchanged indirectly between the process air before being cooled by the evaporator 1 and the process air which has been cooled by the evaporator 1 to lower its absolute humidity.

The refrigerant liquid condensed in the last condensing section 62*e* is depressurized and expanded by the orifice 12 provided at the downstream side of the second heat exchanging portion 22, for thereby lowering its pressure. Then, the refrigerant enters the evaporator 1 and is evaporated therein. The refrigerant cools the process air flowing through the first heat exchanging portion 21, with heat of evaporation. The refrigerant which has been evaporated into a vapor in the evaporator 1 is introduced into the suction side of the compressor 4 through the path 40, and thus the above cycle is repeated.

Figure 4:
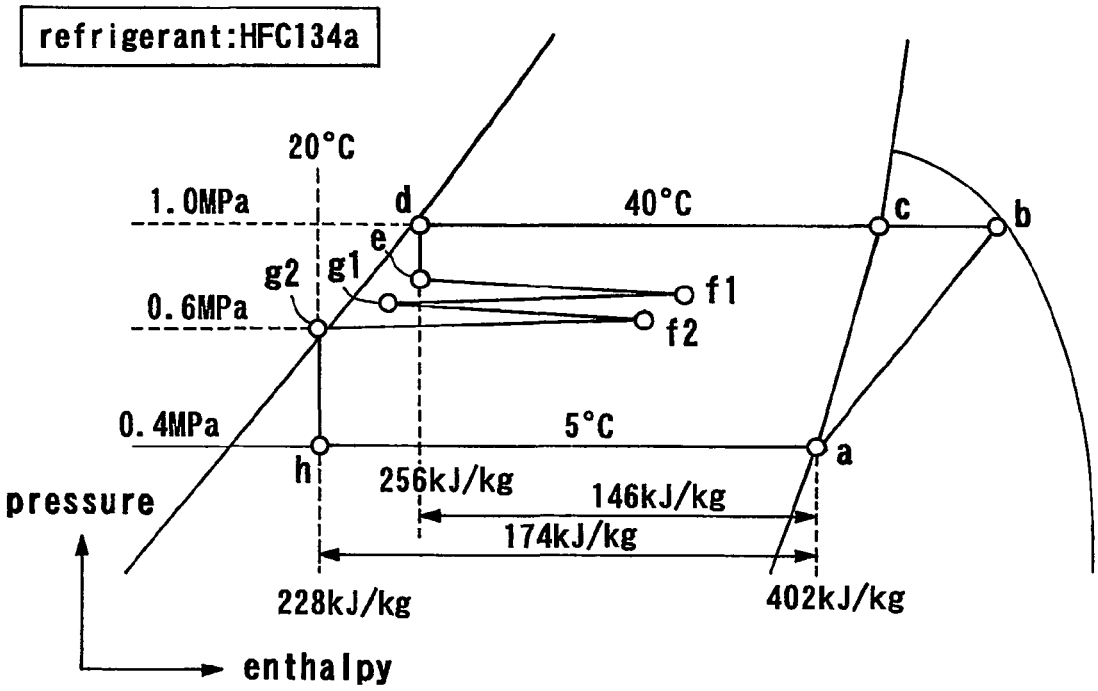
FIG. 4 is a Mollier diagram of a heat pump included in the dehumidifying air-conditioning apparatus shown in FIG. 2.

Next, operation of the heat pump HP1 included in the dehumidifying air-conditioning apparatus according to the present embodiment will be described below with reference to FIG. 4. FIG. 4 is a Mollier diagram of the heat pump HP1 included in the dehumidifying air-conditioning apparatus shown in FIG. 2. The diagram shown in FIG. 4 is a Mollier diagram in the case where HFC134a is used as the refrigerant. In the Mollier diagram, the horizontal axis represents the enthalpy, and the vertical axis represents the pressure. In addition to the above refrigerant, HFC407C and HFC410A are suitable refrigerants for the heat pump and the dehumidifying air-conditioning apparatus according to the present invention. These refrigerants have an operating pressure region shifted toward a higher pressure side than HFC134a.

In FIG. 4, a point "a" represents a state of the refrigerant which has been evaporated by the evaporator 1 shown in FIG. 2, and the refrigerant is in the form of a saturated vapor. The refrigerant has a pressure of 0.4 MPa, a temperature of 5° C., and an enthalpy of 402 kJ/kg. A point b represents a state of the vapor drawn and compressed by the compressor 4, i.e., a state at the outlet port of the compressor 4. In the point b, the refrigerant has a pressure of 1.0 MPa and is in the form of a superheated vapor.

The refrigerant vapor at the point b is cooled in the condenser 5 and reaches a state represented by a point c in the Mollier diagram. In the point c, the refrigerant is in the form of a saturated vapor and has a pressure of 1.0 MPa and a temperature of 40° C. Under this pressure, the refrigerant is cooled and condensed to reach a state represented by a point d. In the point d, the refrigerant is in the form of a saturated liquid and has the same pressure and temperature as those in the point c. The saturated liquid has an enthalpy of 256 kJ/kg.

The refrigerant liquid is isenthalpically depressurized by the orifice 11 and flows into the evaporating section 61*a* in the first heat exchanging portion 21. This state is indicated at a point e on the Mollier diagram. The refrigerant liquid is a mixture of the liquid and the vapor because part of the liquid is evaporated. The pressure of the refrigerant liquid is an intermediate pressure between the condensing pressure in the condenser 5 and the evaporating pressure in the evaporator 1, i.e., is of an intermediate value between 0.4 MPa and 1.0 MPa in the present embodiment.

In the evaporating section 61*a*, the refrigerant liquid is evaporated under the intermediate pressure, and reaches a state represented by a point f1, which is located intermediately between the saturated liquid curve and the saturated vapor curve, under the intermediate pressure. In the point f1, while part of the liquid is evaporated, the refrigerant liquid remains in a considerable amount. The refrigerant in the state represented by the point f1 flows into the condensing sections 62*a*, 62*b*. In the condensing sections 62*a*, 62*b*, heat is removed from the refrigerant by the process air which has a low temperature and flows through the second heat exchanging portion 22, and the refrigerant reaches a state represented by a point g1.

The refrigerant in the state represented by the point g1 flows into the evaporating sections 61*b*, 61*c*, where heat is removed from the refrigerant. The refrigerant increases its liquid phase and reaches a state represented by a point f2. Then, the refrigerant flows into the condensing sections 62*c*, 62*d*, where the refrigerant increases its liquid phase and reaches a state represented by a point g2. On the Mollier diagram, the point g2 is on the saturated liquid curve. In this point, the refrigerant has a pressure of 0.6 MPa, a temperature of 20° C. and an enthalpy of 228 kJ/kg. Similarly, the refrigerant is repeatedly evaporated and condensed alternately in the evaporating sections 61*d*, 61*e* and the condensing section 62*e*. On the Mollier diagram of FIG. 4, the evaporating sections 61*d*, 61*e* and the condensing section 62*e* are omitted from illustration, on the assumption that the condensing section 62*d* is connected to the orifice 12.

The refrigerant liquid at the point g2 is isenthalpically depressurized to 0.4 MPa, which is a saturated pressure at a temperature of 5° C., by the orifice 12, and reaches a state represented by a point h. The refrigerant at the point h flows as a mixture of the refrigerant liquid and the vapor at a temperature of 5° C. into the evaporator 1, where the refrigerant removes heat from the process air to thus be evaporated into a saturated vapor at the state indicated by the point a on the Mollier diagram. The evaporated vapor is drawn again by the compressor 4, and thus the above cycle is repeated.

In the heat exchanger 2, as described above, the refrigerant goes through changes of the evaporated state from the point e to the point f1 or from the point g1 to the point f2 in the evaporating section 61, and goes through changes of the condensed state from the point f1 to the point g1 or from the point f2 to the point g2 in the condensing section 62. Since the refrigerant transfers heat by way of evaporation and condensation, the rate of heat transfer is very high and the efficiency of heat exchanger is high.

In the vapor compression type heat pump HP1 including the compressor 4, the condenser 5, the orifices 11, 12, and the evaporator 1, when the heat exchanger 2 is not provided, the refrigerant at the state represented by the point d in the condenser 5 is returned to the evaporator 1 through the orifices. Therefore, the enthalpy difference that can be used by the evaporator 1 is only 402−256=146 kJ/kg. With the heat pump HP1 according to the present embodiment which has the heat exchanger 2, however, the enthalpy difference that can be used by the evaporator 1 is 402−228=174 kJ/kg. Thus, the amount of refrigerant that is circulated to the compressor under the same cooling load and the required power can be reduced by 16% (=1−146/174). Consequently, the heat pump HP1 according to the present embodiment can perform the same operation as with a well-known subcooled cycle.

Figure 5:
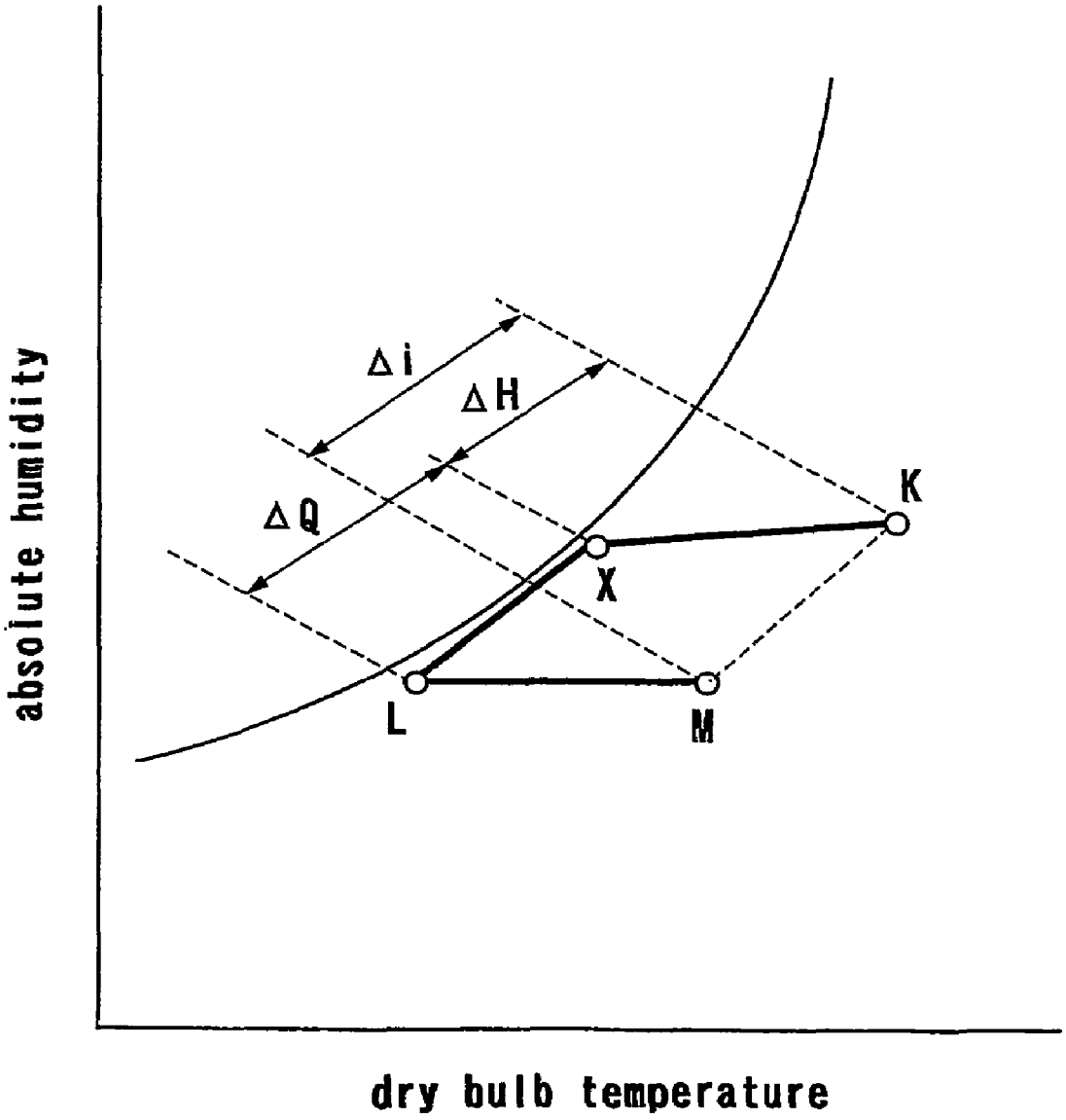
FIG. 5 is a psychrometric chart showing an air-conditioning cycle in the dehumidifying air-conditioning apparatus shown in FIG. 2.

FIG. 5 is a psychrometric chart showing an air-conditioning cycle in the dehumidifying air-conditioning apparatus shown in FIG. 2. In FIG. 5, the alphabetical letters K, L, M, X correspond to states in the paths indicated by the encircled letters in FIG. 2.

In FIG. 5, the process air (in a state K) from the air-conditioned space 100 flows through the path 30 into the first heat exchanging portion 21 in the heat exchanger 2, where the process air is cooled to a certain extent by the refrigerant that is evaporated in the evaporating section 61. This process can be referred to as precooling because the process air is preliminarily cooled before being cooled to a temperature lower than its dew point by the evaporator 1. While the process air is being precooled in the evaporating section 61, a certain amount of moisture is removed from the air to lower the absolute humidity of the air, and then air reaches a point X on the saturation curve. Alternatively, the air may be precooled to an intermediate point between the point K and the point X. Further, the air may be precooled to a point that is shifted beyond the point X slightly toward a lower humidity on the saturation curve.

The process air precooled by the first heat exchanging portion 21 is introduced through the path 31 into the evaporator 1, where the process air is cooled to a temperature lower than its dew point by the refrigerant which has been depressurized by the orifice 12 and is evaporated at a low temperature. Moisture is removed from the air to lower the absolute humidity and the dry bulb temperature of the air, and the air reaches a point L. Although the thick line representing a change from the point X to the point L is plotted as being remote from the saturation curve for illustrative purpose in FIG. 5, it is actually aligned with the saturation curve.

The process air in the state represented by the point L flows through the path 32 into the second heat exchanging portion 22 in the heat exchanger 2, where the process air is heated, with the constant absolute humidity, by the refrigerant condensed in the condensing section 62, and reaches a point M. The process air in the point M has a sufficiently lower absolute humidity than the process air in the point K, a dry bulb temperature which is not excessively lower than the process air in the point K, and a suitable relative humidity. The process air in the point M is then drawn by the air blower 3 and returned to the air-conditioned space 100 through the path 34.

In the air cycle on the psychrometric chart shown in FIG. 5, the amount of heat which has precooled the process air in the first heat exchanging portion 21, i.e., the amount ΔH of heat which has reheated the process air in the second heat exchanging portion 22, represents the amount of heat recovered, and the amount of heat which has cooled the process air in the evaporator 1 is represented by ΔQ. The cooling effect for cooling the air-conditioned space 100 is represented by Δi.

As described above, in the heat exchanger 2, the process air is precooled by evaporation of the refrigerant in the evaporating section 61, and the process air is reheated by condensation of the refrigerant in the condensing section 62. The refrigerant evaporated in the evaporating section 61 is condensed in the condensing section 62. The same refrigerant is thus evaporated and condensed to perform heat exchange indirectly between the process air before being cooled in the evaporator 1 and the process air after being cooled in the evaporator 1.

In the embodiment described above, the same refrigerant is used as a heat transfer medium in the evaporator for cooling the process air to a temperature lower than its dew point, the precooler for precooling the process air, and the reheater for reheating the process air. Therefore, the refrigerant system is simplified. The refrigerant is positively circulated because the pressure difference between the evaporator and the condenser can be utilized. Since a phase change phenomenon is applied to heat exchanges for precooling and reheating the process air, a high heat transfer efficiency can be achieved.

In the present embodiment, the upstream orifice 11 has an opening area smaller than the downstream orifice 12, and hence the throttling effect of the upstream orifice 11 is set to be larger than that of the downstream orifice 12. If a large amount of the refrigerant vapor passes through the orifice 11 and flows into the evaporating section 61, then the refrigerant vapor releases heat in the evaporating section 61, resulting in lowered cooling effect for cooling the process air in the evaporating section 61. Further, when the opening area of the orifice 12 is reduced, i.e., when the throttling effect of the orifice 12 is increased, the refrigerant is stagnated in the heat exchanger 2 located at the upstream side of the orifice 12. As a result, the aforementioned phase change cannot smoothly be developed in the evaporating section 61 and the condensing section 62. In the present embodiment, since the upstream orifice 11 has an opening area smaller than the downstream orifice 12, the refrigerant vapor is restrained from passing through the upstream orifice 11, and hence it is possible to increase the cooling effect for cooling the process air in the evaporating section 61. Further, the refrigerant is restrained from being stagnated in the refrigerant path of the heat exchanger 2 due to the downstream orifice 12, and hence the efficiency of heat exchange is increased in the heat exchanger 2.

Figure 6:
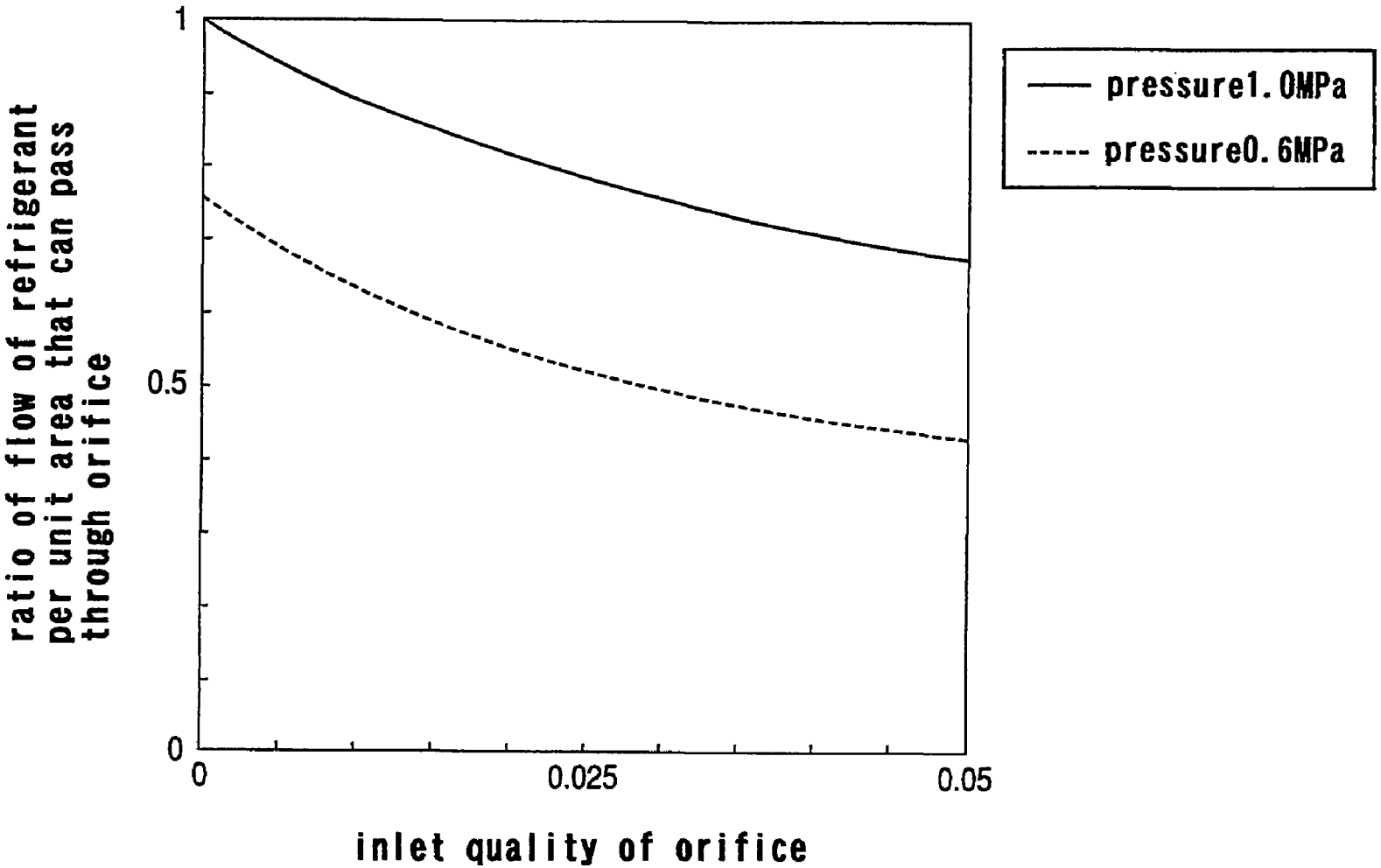
FIG. 6 is a graph showing the relationship between a quality at an inlet of an orifice and a ratio of the flow of a refrigerant per unit area that can pass through the orifice in the dehumidifying air-conditioning apparatus shown in FIG. 2.

FIG. 6 is a graph showing the relationship between a quality at the inlet of the orifice and a ratio of the flow of the refrigerant per unit area that can pass through the orifice in the dehumidifying air-conditioning apparatus shown in FIG. 2. In FIG. 6, a solid line represents a refrigerant having a pressure of 1.0 MPa, i.e., a refrigerant at the inlet of the upstream orifice 11, and a dotted line represents a refrigerant having a pressure of 0.6 MPa, i.e., a refrigerant at the inlet of the downstream orifice 12. As shown in FIG. 6, it is desirable that the opening area of the downstream orifice 12 should be 1/0.7 to 1/0.8 times, i.e., 1.25 to 1.43 times as large as that of the upstream orifice 11.

The qualities at the inlets of the upstream orifice 11 and the downstream orifice 12 may be different from each other. Preferably, the quality at the inlet of the upstream orifice 11 is smaller than the quality at the inlet of the downstream orifice 12. For example, the quality at the inlet of the upstream orifice 11 is in the range of 0.000 to 0.002, and the quality at the inlet of the downstream orifice 12 is in the range of 0.008 to 0.010. In such a case, the refrigerant can reliably be evaporated and condensed in the heat exchanger 2 for thereby preventing the refrigerant liquid from being stagnated in the refrigerant path of the heat exchanger 2. The qualities of the inlets of the upstream and downstream orifices 11, 12 can be set to the above values by properly adjusting the throttling effects of these orifices.

Figure 7:
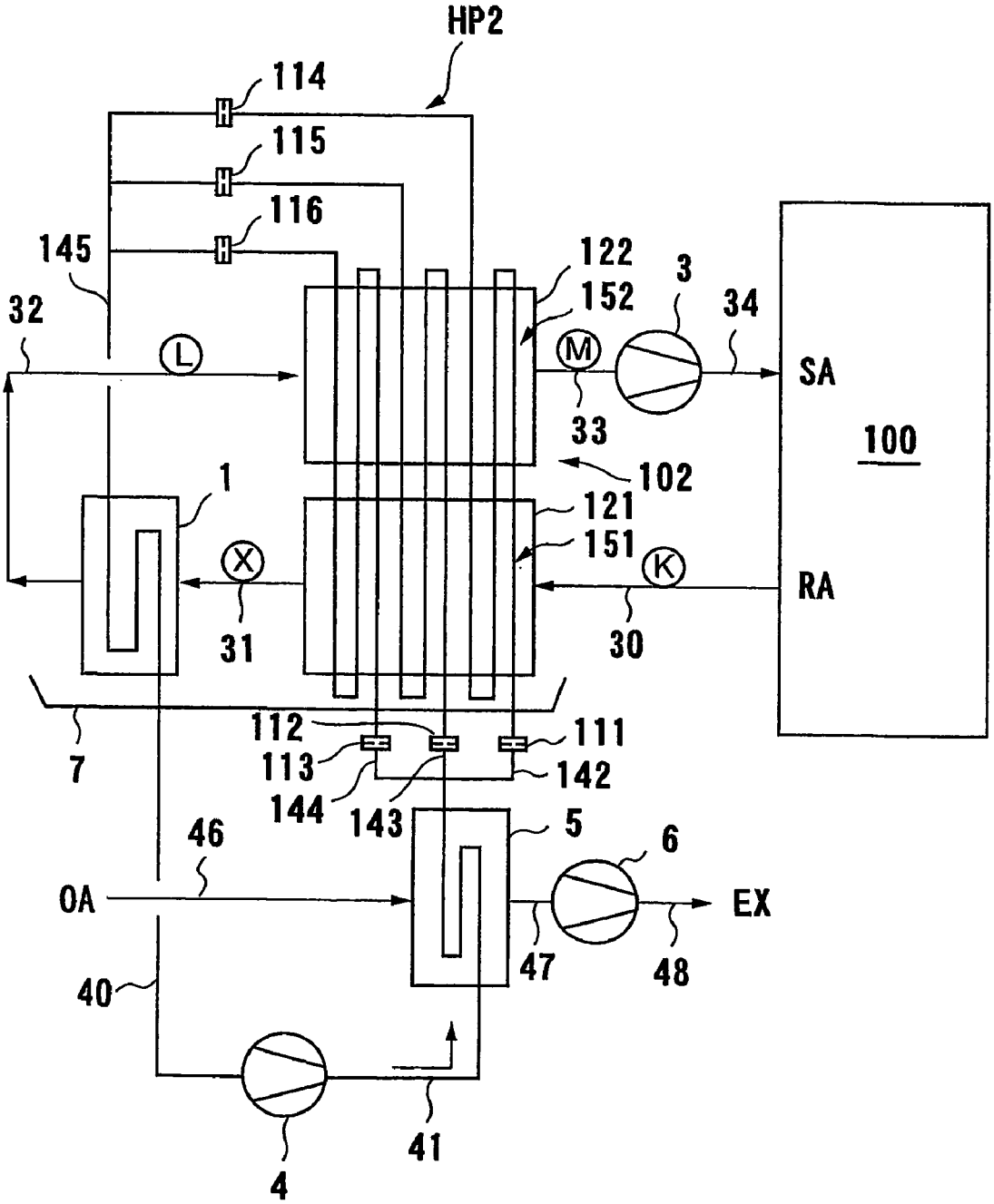
FIG. 7 is a flow diagram of a dehumidifying air-conditioning apparatus according to a second embodiment of the present invention.
Figure 8:
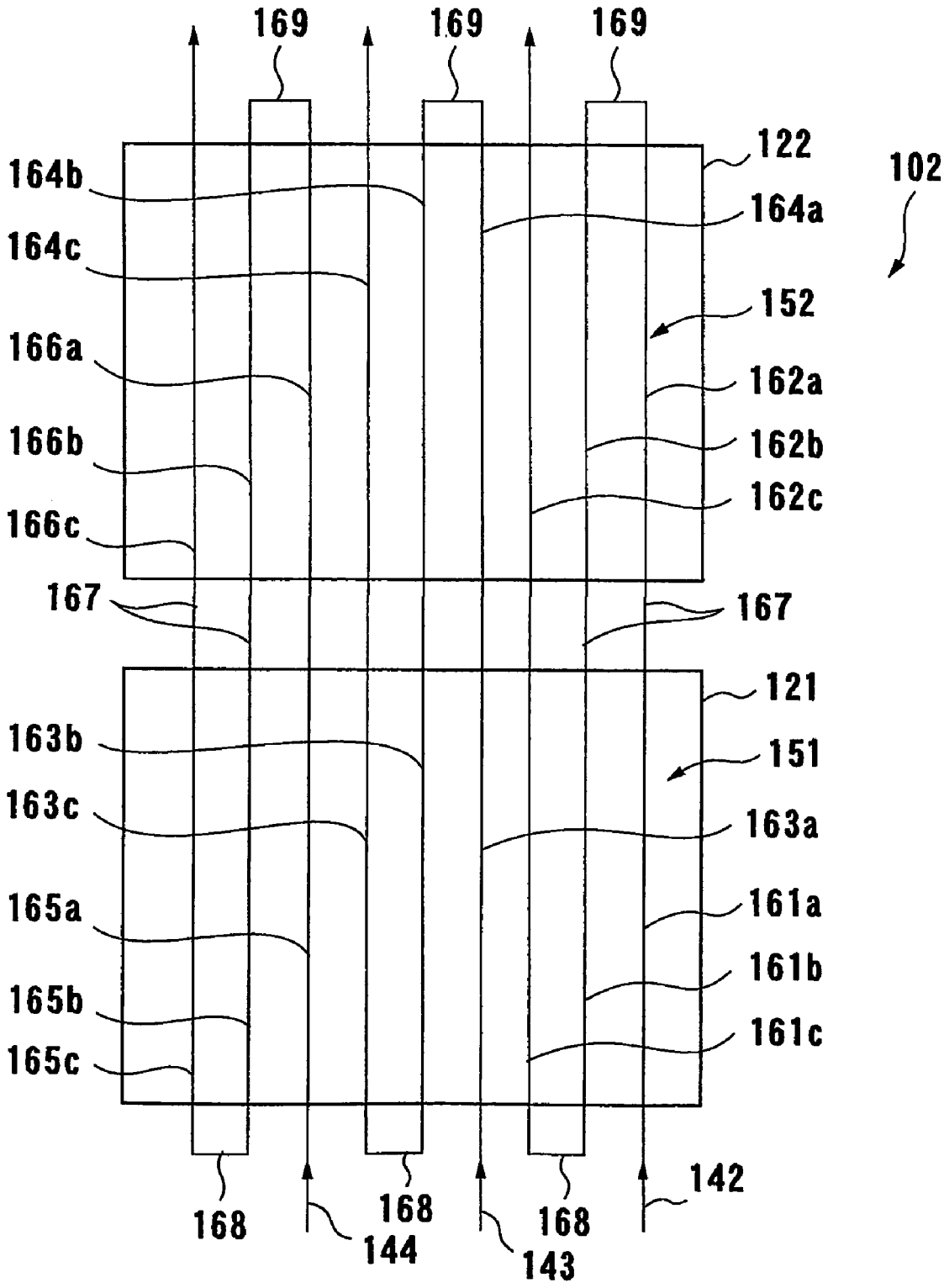
FIG. 8 is an enlarged view showing branched refrigerant paths in a heat exchanger of the dehumidifying air-conditioning apparatus shown in FIG. 7.
Figure 9:
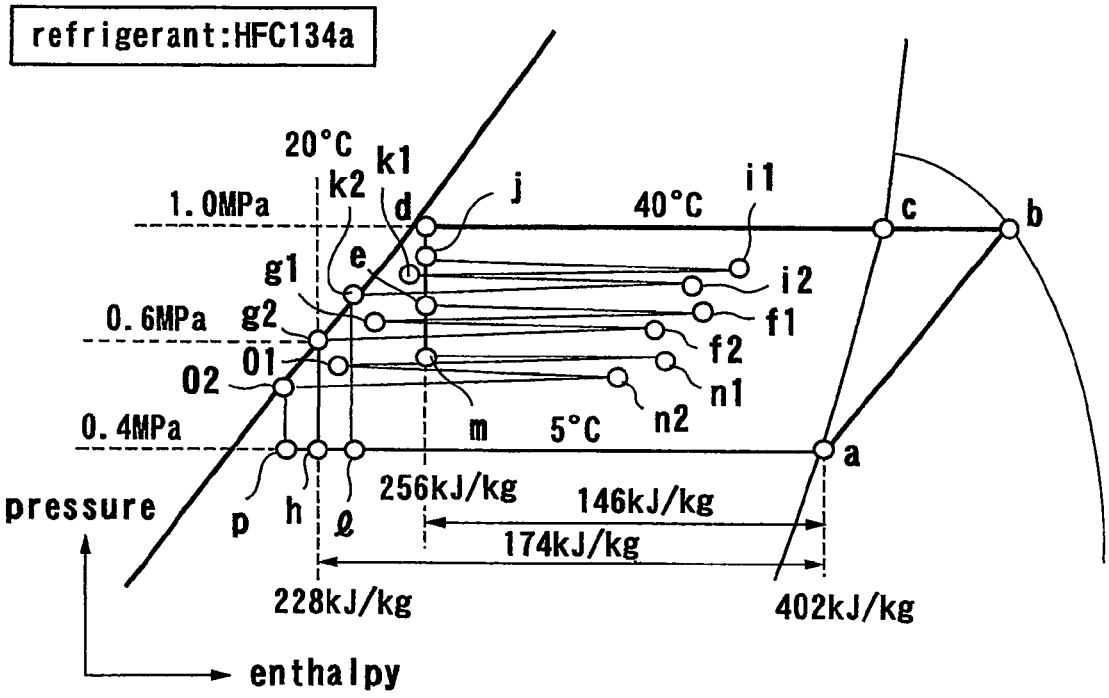
FIG. 9 is a Mollier diagram of a heat pump included in the dehumidifying air-conditioning apparatus shown in FIG. 7.

A dehumidifying air-conditioning apparatus according to a second embodiment of the present invention will be described below with reference to FIGS. 7 through 9. FIG. 7 is a flow diagram of a dehumidifying air-conditioning apparatus according to the second embodiment of the present invention. In FIGS. 7 through 9, like parts and components are denoted by the same reference numerals and characters as those of the first embodiment and will not be described below.

The refrigerant path connecting the condenser 5 and the evaporator 1 is branched into a plurality of branched refrigerant paths at the downstream side of the condenser 5. In FIG. 7, three branched refrigerant paths 142, 143, 144 are formed at the downstream side of the condenser 5. The branched refrigerant paths 142, 143, 144 are joined to one path 145 at the upstream side of the evaporator 1. The branched refrigerant paths 142, 143, 144 penetrate the first heat exchanging portion 121 and the second heat exchanging portion 122 in the heat exchanger 102, respectively. An evaporating section 151 for evaporating the refrigerant to cool the process air which flows through the first heat exchanging portion 121 is provided in the first heat exchanging portion 121 of the heat exchanger 102. A condensing section 152 for condensing the refrigerant to heat (reheat) the process air which flows through the second heat exchanging portion 122 is provided in the second heat exchanging portion 122 of the heat exchanger 102.

Orifices (upstream orifices) 111, 112, 113 are disposed as first restrictions on the respective branched refrigerant paths 142, 143, 144 at the upstream side of the first heat exchanging portion 121. Orifices (downstream orifices) 114, 115, 116 are disposed as second restrictions on the respective branched refrigerant paths 142, 143, 144 at the downstream side of the second heat exchanging portion 122. The upstream orifices 111, 112, 113 have opening areas smaller than the downstream orifices 114, 115, 116 on the respective refrigerant paths. Therefore, the throttling effects (flow reducing effects) of the upstream orifices 111, 112, 113 are larger than the throttling effects of the downstream orifices 114, 115, 116.

FIG. 8 is an enlarged view showing the branched refrigerant paths 142, 143, 144 in the heat exchanger 102 of the dehumidifying air-conditioning apparatus shown in FIG. 7. The refrigerant paths including the evaporating section 151 and the condensing section 152 penetrate the first heat exchanging portion 121 and the second heat exchanging portion 122 in the heat exchanger 102, alternately and repeatedly. Specifically, as shown in FIG. 8, the refrigerant path 142 has an evaporating section 161*a*, a condensing section 162*a*, a condensing section 162*b*, an evaporating section 161*b*, an evaporating section 161*c*, and a condensing section 162*c*, in the order from the condenser 5. The refrigerant path 143 has an evaporating section 163*a*, a condensing section 164*a*, a condensing section 164*b*, an evaporating section 163*b*, an evaporating section 163*c*, and a condensing section 164*c*, in the order from the condenser 5. The refrigerant path 144 has an evaporating section 165*a*, a condensing section 166*a*, a condensing section 166*b*, an evaporating section 165*b*, an evaporating section 165*c*, and a condensing section 166*c*, in the order from the condenser 5.

The heat exchanger 102 has the first heat exchanging portion 121 for allowing the process air before flowing through the evaporator 1 to pass therethrough, and the second heat exchanging portion 122 for allowing the process air after flowing through the evaporator 1 to pass therethrough. The first heat exchanging portion 121 and the second heat exchanging portion 122 form respective separate spaces, each in the form of a rectangular parallelepiped. The evaporator 1 is disposed between the first heat exchanging portion 121 and the second heat exchanging portion 122. The first heat exchanging portion 121 and the second heat exchanging portion 122 have a plurality of substantially parallel heat exchange tubes as refrigerant passages in each of a plurality of planes which lie perpendicularly to the flow of the process air. Tubes 167 are provided across the evaporator 1 between the corresponding sections, for example, the evaporating section 161*a* and the condensing section 162*a*, the evaporating section 161*b* and the condensing section 162*b*, and the evaporating section 161*c* and the condensing section 162*c*. Thus, the corresponding evaporating and condensing sections are connected to each other. The ends of the evaporating sections 161*b*, 161*c*, the ends of the evaporating sections 163*b*, 163*c*, and the ends of the evaporating sections 165*b*, 165*c* are connected to each other by U tubes 168. Similarly, the ends of the condensing sections 162*a*, 162*b*, the ends of the condensing sections 164*a*, 164*b*, and the ends of the condensing sections 166*a*, 166*b* are connected to each other by U tubes 169.

With the above arrangement, for example, in the refrigerant path 142, the refrigerant flowing in one direction from the evaporating section 161*a* to the condensing section 162*a* is introduced into the condensing section 162*b* by the U tube 169. The refrigerant introduced into the condensing section 162*b* then flows into the evaporating section 161*b*, from which the refrigerant flows into the evaporating section 161*c* via the U tube 168 and further flows into the condensing section 162*c*. In this manner, the refrigerant passages are provided as a group of meandering thin pipes. A group of meandering thin pipes pass through the first heat exchanging portion 121 and the second heat exchanging portion 122, and are held in alternate contact with the process air which has a higher temperature and the process air which has a lower temperature.

The flow of the refrigerant in the devices will be described below with reference to FIGS. 7 and 8.

A refrigerant vapor pressurized by the compressor 4 is introduced into the condenser 5 via the refrigerant pipe 41 connected to the discharge port of the compressor 4. The refrigerant vapor compressed by the compressor 4 is cooled and condensed by the outside air OA as cooling air. The refrigerant liquid flowing out of the condenser 5 is branched into the branched refrigerant paths 142, 143, 144. The refrigerants similarly flow through the respective refrigerant paths 142, 143, 144. Therefore, the refrigerant flowing through the refrigerant path 142 will mainly be described below, and the refrigerants flowing through the other refrigerant paths 143, 144 will not be described in detail below.

The refrigerant flowing through the refrigerant path 142 is depressurized by the orifice 111 and expanded so as to be partly evaporated (flashed). The refrigerant which is a mixture of the liquid and the vapor reaches the evaporating section 161*a*, where the refrigerant liquid flows so as to wet the inner wall surface of the tube in the evaporating section 161*a*. The refrigerant flows into the evaporating section 161*a* in the liquid phase. The refrigerant may be a refrigerant liquid which has been partly evaporated to slightly contain a vapor phase. While the refrigerant liquid is flowing through the evaporating section 161*a*, it is evaporated to cool (precool) the process air before flowing into the evaporator 1. The refrigerant itself is heated while increasing the vapor phase thereof.

As described above, the evaporating section 161*a* and the condensing section 162*a* are constructed as a continuous tube. Specifically, since the evaporating section 161*a* and the condensing section 162*a* are provided as an integral passage, the refrigerant vapor evaporated in the evaporating section 161*a* (and the refrigerant liquid which has not been evaporated) flows into the condensing section 162*a*, and heats (reheats) the process air, which has been cooled and dehumidified in the evaporator 1 and has a temperature lower than the process air in the evaporating section 161*a*. At this time, heat is removed from the evaporated refrigerant vapor itself, and while the evaporated refrigerant vapor in the vapor phase is condensed, the refrigerant flows into the next condensing section 162*b*. While the refrigerant is flowing through the condensing section 162*b*, heat is further removed from the refrigerant by the process air having a lower temperature, and the refrigerant in the vapor phase is further condensed.

The condensed refrigerant liquid flows into the next evaporating section 161*b* and the subsequent evaporating section 161*c* to cool (precool) the process air before flowing into the evaporator 1 in the same manner as described above. Thereafter, the refrigerant vapor flows into the condensing section 162*c* to heat (reheat) the process air. In this manner, the refrigerant flows through the branched refrigerant path while changing in phase between the vapor phase and the liquid phase. Thus, heat is exchanged indirectly between the process air before being cooled by the evaporator 1 and the process air which has been cooled by the evaporator 1 to lower its absolute humidity.

The refrigerant liquid condensed in the condensing section 162*c* is depressurized and expanded by the orifice 114 provided at the downstream side of the second heat exchanging portion 122, for thereby lowering its pressure. Then, the refrigerant liquid is joined to the refrigerants which have flowed through the other branched refrigerant liquid paths 143, 144. The joined refrigerant liquid enters the evaporator 1 via the path 145, and the refrigerant is evaporated in the evaporator 1 to cool the process air with heat of evaporation. The refrigerant which has been evaporated into a vapor in the evaporator 1 is introduced into the suction side of the compressor 4 through the path 40, and thus the above cycle is repeated.

Next, operation of the heat pump HP2 included in the dehumidifying air-conditioning apparatus according to the second embodiment of the present invention will be described below with reference to FIG. 9. FIG. 9 is a Mollier diagram of the heat pump HP2 included in the dehumidifying air-conditioning apparatus shown in FIG. 7. The diagram shown in FIG. 9 is a Mollier diagram in the case where HFC134a is used as the refrigerant. In the Mollier diagram, the horizontal axis represents the enthalpy, and the vertical axis represents the pressure. In addition to the above refrigerant, HFC407C and HFC410A are suitable refrigerants for the heat pump and the dehumidifying air-conditioning apparatus according to the present invention. These refrigerants have an operating pressure region shifted toward a higher pressure side than HFC134a.

In FIG. 9, a point "a" represents a state of the refrigerant which has been evaporated by the evaporator 1 shown in FIG. 7, and the refrigerant is in the form of a saturated vapor. The refrigerant has a pressure of 0.4 MPa, a temperature of 5° C., and an enthalpy of 402 kJ/kg. A point b represents a state of the vapor drawn and compressed by the compressor 4, i.e., a state at the outlet port of the compressor 4. In the point b, the refrigerant has a pressure of 1.0 MPa and is in the form of a superheated vapor.

The refrigerant vapor at the point b is cooled in the condenser 5 and reaches a state represented by a point c in the Mollier diagram. In the point c, the refrigerant is in the form of a saturated vapor and has a pressure of 1.0 MPa and a temperature of 40° C. Under this pressure, the refrigerant is cooled and condensed to reach a state represented by a point d. In the point d, the refrigerant is in the form of a saturated liquid and has the same pressure and temperature as those in the point c. The saturated liquid has an enthalpy of 256 kJ/kg.

The refrigerant liquid is branched into the branched refrigerant liquid paths 142, 143, 144, and the branched refrigerant liquids flow into the heat exchanger 102. First, the refrigerant flowing through the refrigerant path 143 will be described below. The refrigerant liquid is isenthalpically depressurized by the orifice 112 and flows into the evaporating section 163*a* in the first heat exchanging portion 121. This state is indicated at a point e on the Mollier diagram. The refrigerant liquid is a mixture of the liquid and the vapor because a part of the liquid is evaporated. The pressure of the refrigerant liquid is an intermediate pressure between the condensing pressure in the condenser 5 and the evaporating pressure in the evaporator 1, i.e., is of an intermediate value between 0.4 MPa and 1.0 MPa in the present embodiment.

In the evaporating section 163*a*, the refrigerant liquid is evaporated under the intermediate pressure, and reaches a state represented by a point f1, which is located intermediately between the saturated liquid curve and the saturated vapor curve, under the intermediate pressure. In the point f1, while a part of the liquid is evaporated, the refrigerant liquid remains in a considerable amount. The refrigerant in the state represented by the point f1 flows into the condensing sections 164*a*, 164*b*. In the condensing sections 164*a*, 164*b*, heat is removed from the refrigerant by the process air which has a low temperature and flows through the second heat exchanging portion 122, and the refrigerant reaches a state represented by a point g1.

The refrigerant in the state represented by the point g1 flows into the evaporating sections 163*b*, 163*c*, where heat is removed from the refrigerant. The refrigerant increases its liquid phase and reaches a state represented by a point f2. Then, the refrigerant flows into the condensing section 164*c*, where the refrigerant increases its liquid phase and reaches a state represented by a point g2. On the Mollier diagram, the point g2 is on the saturated liquid curve. In this point, the refrigerant has a pressure of 0.6 MPa, a temperature of 20° C. and an enthalpy of 228 kJ/kg.

The refrigerant liquid at the point g2 is isenthalpically depressurized to 0.4 MPa, which is a saturated pressure at a temperature of 5° C., by the orifice 115, and reaches a state represented by a point h. The refrigerant at the point h flows as a mixture of the refrigerant liquid and the vapor at a temperature of 5° C. into the evaporator 1, where the refrigerant removes heat from the process air to thus be evaporated into a saturated vapor at the state indicated by the point a on the Mollier diagram. The evaporated vapor is drawn again by the compressor 4, and thus the above cycle is repeated.

In the same manner as described above, the refrigerant flowing into the refrigerant path 142 passes through the orifice 111, the evaporating sections, the condensing sections, and the orifice 114. The refrigerant goes through states represented by points j, i1, k1, i2, and k2 and reaches a state represented by a point 1. The refrigerant flowing into the refrigerant path 144 passes through the orifice 113, the evaporating sections, the condensing sections, and the orifice 116. The refrigerant goes through states represented by points m, n1, o1, n2, and o2 and reaches a state represented by a point p.

In the heat exchanger 102, as described above, the refrigerant goes through changes of the evaporated state from the point e to the point f1 or from the point g1 to the point f2 in the evaporating section 151, and goes through changes of the condensed state from the point f1 to the point g1 or from the point f2 to the point g2 in the condensing section 152. Since the refrigerant transfers heat by way of evaporation and condensation, the rate of heat transfer is very high and the efficiency of heat exchanger is high.

In the vapor compression type heat pump HP2 including the compressor 4, the condenser 5, the orifices 111–116, and the evaporator 1, when the heat exchanger 102 is not provided, the refrigerant at the state represented by the point d in the condenser 5 is returned to the evaporator 1 through the orifices. Therefore, the enthalpy difference that can be used by the evaporator 1 is only 402−256=146 kJ/kg. With the heat pump HP2 according to the present embodiment which has the heat exchanger 102, however, the enthalpy difference that can be used by the evaporator 1 is 402−228=174 kJ/kg. Thus, the amount of refrigerant that is circulated to the compressor under the same cooling load and the required power can be reduced by 16% (=1−146/174). Consequently, the heat pump HP2 according to the present embodiment can perform the same operation as with a well-known subcooled cycle.

The psychrometric chart shown in FIG. 5 according to the first embodiment is also applicable to the present embodiment, and an air-conditioning cycle according to the present embodiment will not be described below repetitively.

As described above, in the heat exchanger 102, the process air is precooled by evaporation of the refrigerant in the evaporating section 151, and the process air is reheated by condensation of the refrigerant in the condensing section 152. The refrigerant evaporated in the evaporating section 151 is condensed in the condensing section 152. The same refrigerant is thus evaporated and condensed to perform heat exchange indirectly between the process air before being cooled in the evaporator 1 and the process air after being cooled in the evaporator 1.

In the embodiment described above, the same refrigerant is used as a heat transfer medium in the evaporator for cooling the process air to a temperature lower than its dew point, the precooler for precooling the process air, and the reheater for reheating the process air. Therefore, the refrigerant system is simplified. The refrigerant is positively circulated because the pressure difference between the evaporator and the condenser can be utilized. Since a phase change phenomenon is applied to heat exchanges for precooling and reheating the process air, a high heat transfer efficiency can be achieved.

In the present embodiment, the upstream orifices 111, 112, 113 have opening areas smaller than the downstream orifices 114, 115, 116 on the respective refrigerant paths 142, 143, 144, and hence the throttling effects of the upstream orifices 111, 112, 113 are set to be larger than the throttling effects of the downstream orifices 114, 115, 116. As described in the first embodiment, since the upstream orifices 111, 112, 113 have opening areas smaller than the downstream orifices 114, 115, 116, the refrigerant vapors are restrained from passing through the upstream orifices 111, 112, 113, and hence it is possible to increase the cooling effect for cooling the process air in the evaporating section 151. Further, the refrigerants are restrained from being stagnated in the refrigerant paths of the heat exchanger 102 due to the downstream orifices 114, 115, 116, and hence the efficiency of heat exchange is increased in the heat exchanger 102.

In the embodiment described above, the refrigerant path is branched into the three branched refrigerant paths. However, the present invention is not limited to three branched refrigerant paths. The refrigerant path may be branched into any number of branched refrigerant paths. Thus, when a plurality of branched refrigerant paths are provided, the operative temperature of the refrigerant can gradually be changed to achieve a high efficiency of heat exchange.

In the present embodiment, a refrigerant path is branched into a plurality of refrigerant paths at the downstream side of the condenser 5 to form branched refrigerant paths 142, 143, 144, and the branched refrigerant paths 142, 143, 144 are joined to the one path 145 at the upstream side of the evaporator 1. However, the branched refrigerant paths 142, 143, 144 may extend to the interior of the evaporator 1, and may be joined to each other at the downstream side of the evaporator 1.

In the first and second embodiments, the orifice is used as a restriction provided on the refrigerant path. However, the restriction is not limited to the orifice. For example, the restriction may comprise a capillary tube, an expansion valve, or the like. Examples of restrictions other than the orifice will be described below.

Figure 10:
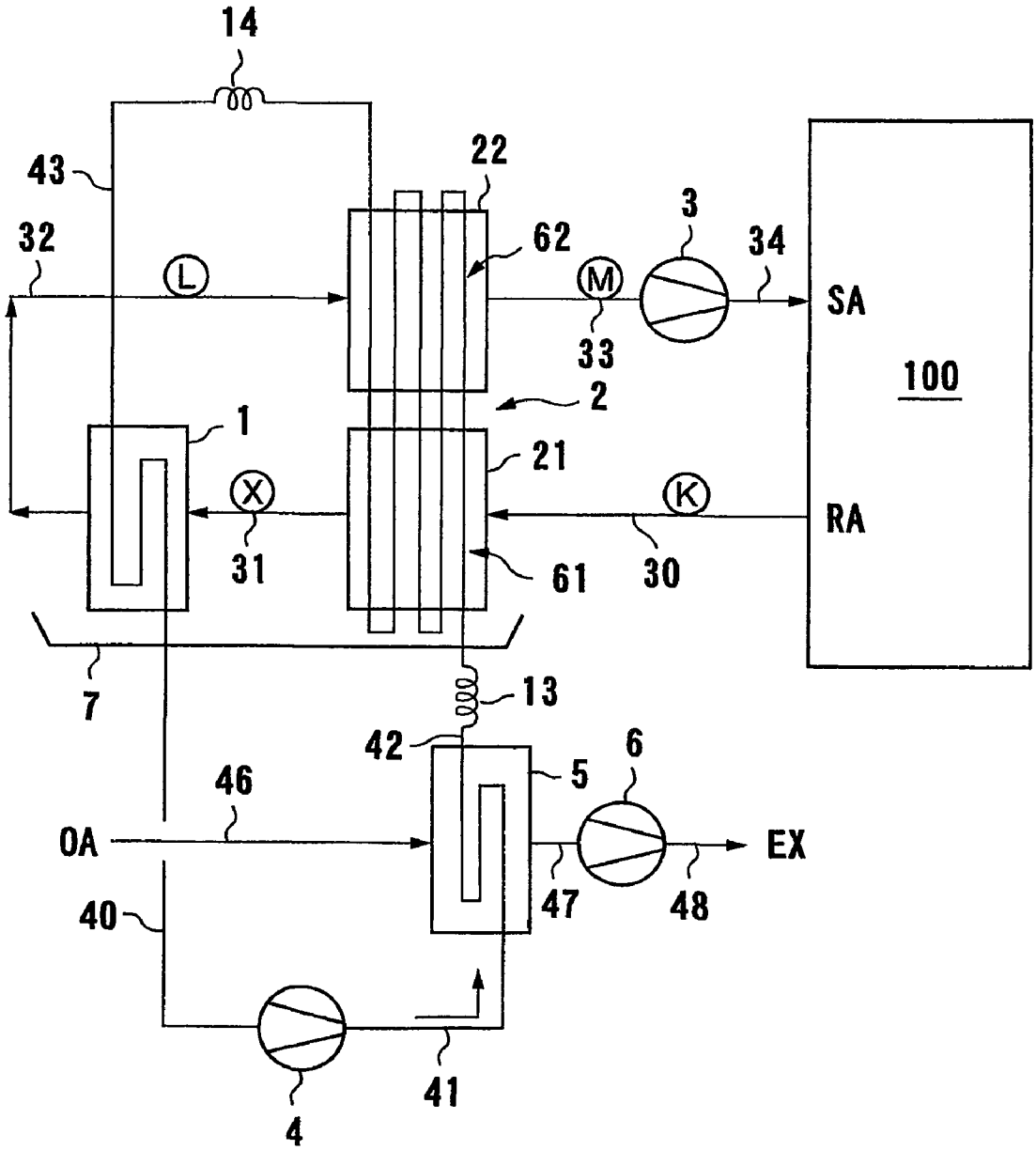
FIG. 10 is a flow diagram of a dehumidifying air-conditioning apparatus according to a third embodiment of the present invention.

FIG. 10 is a flow diagram in the case of a third embodiment where capillary tubes are used instead of the orifices of the dehumidifying air-conditioning apparatus in the first embodiment. When capillary tubes are used instead of the orifices, the throttling effect (flow reducing effect) of an upstream capillary tube 13 as a first restriction is set to be larger than that of a downstream capillary tube 14 as a second restriction. For example, the throttling effect of the upstream capillary tube 13 can be made larger than that of the downstream capillary tube 14 by adjusting the length or the inside diameter of the capillary tubes 13, 14.

Figure 11:
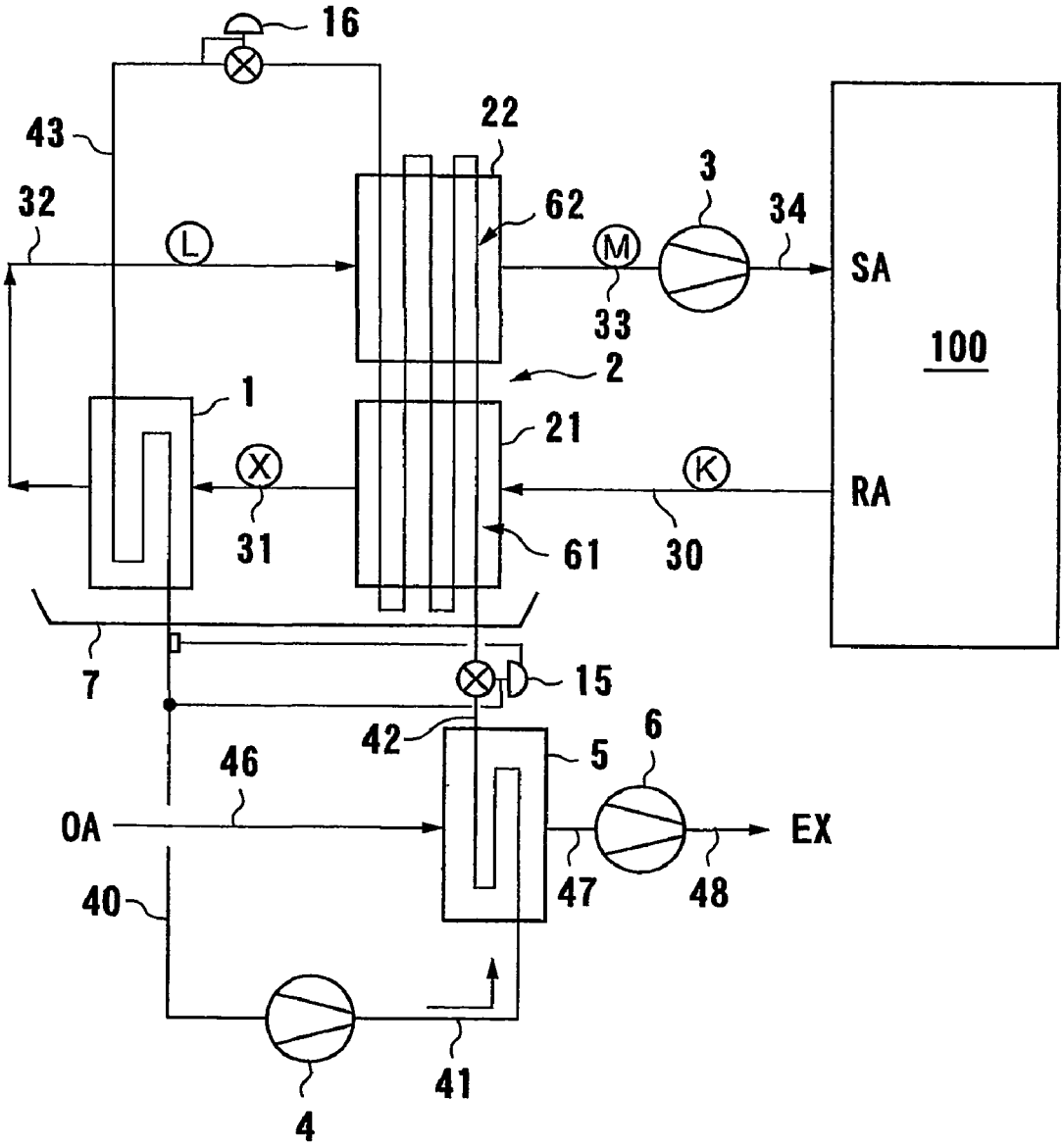
FIG. 11 is a flow diagram of a dehumidifying air-conditioning apparatus according to a fourth embodiment of the present invention.

FIG. 11 is a flow diagram in the case of a fourth embodiment where expansion valves are used instead of the orifices of the dehumidifying air-conditioning apparatus in the first embodiment. When expansion valves are used instead of the orifices, a thermal expansion valve 15 for external pressure equalization 15 is disposed as a first restriction at the upstream side of the heat exchanging portion, and a constant pressure expansion valve 16 is disposed as a second restriction at the downstream side of the heat exchanging portion. These expansion valves may electrically be actuated. The expansion valve 15 is controlled by the temperature and pressure of the refrigerant flowing through the refrigerant path 40 at the downstream of the evaporator 1. Specifically, the opening of the expansion valve 15 is controlled so as to superheat the refrigerant flowing through the refrigerant path 40 at the downstream of the evaporator 1. In this case, the downstream expansion valve 16 is controlled that the opening area thereof is larger than that of the upstream expansion valve 15. Thus, the throttling effect of the upstream expansion valve 15 is set to be larger than that of the downstream expansion valve 16.

Figure 12:
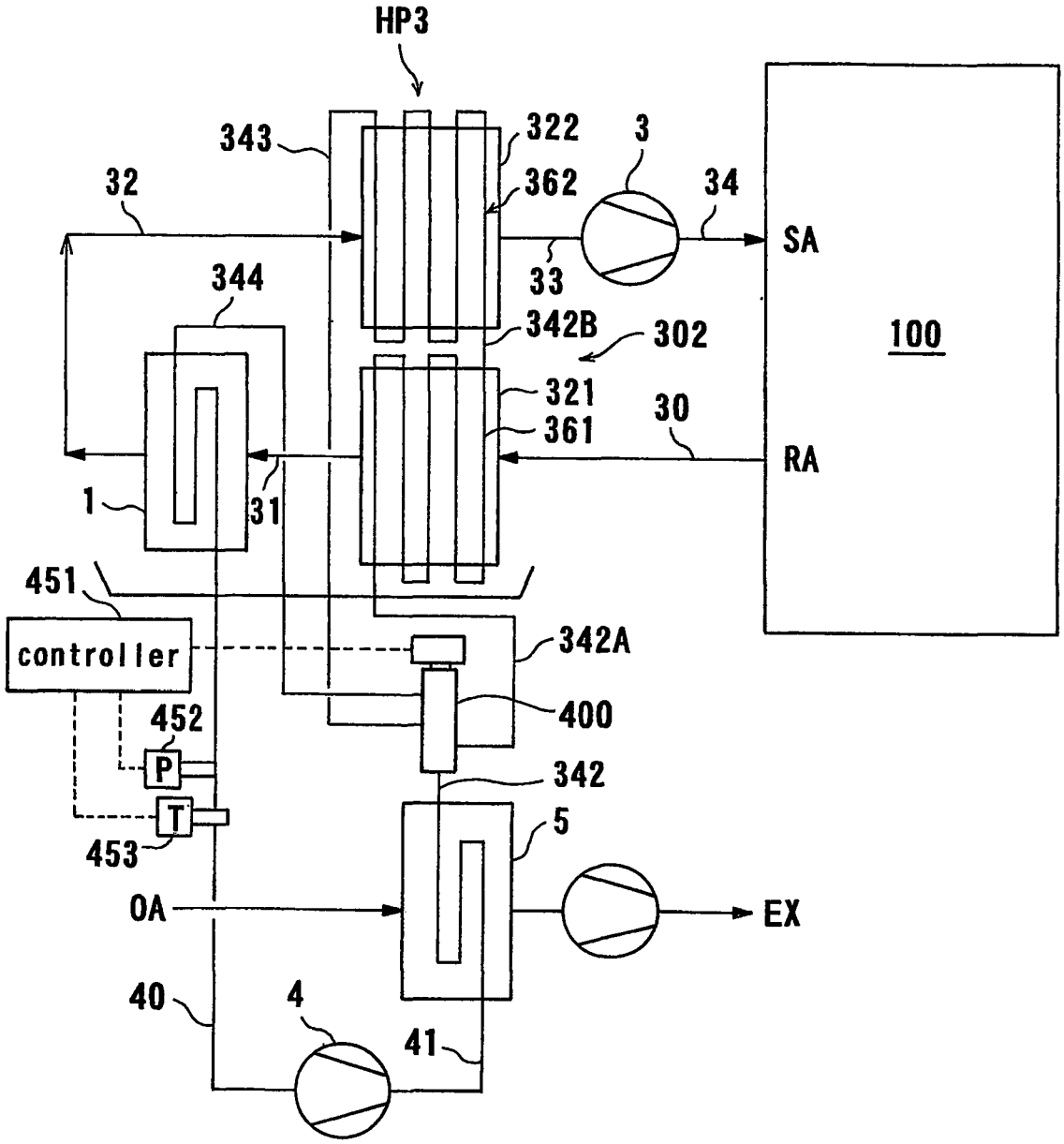
FIG. 12 is a flow diagram of a dehumidifying air-conditioning apparatus according to a fifth embodiment of the present invention.
Figure 13:
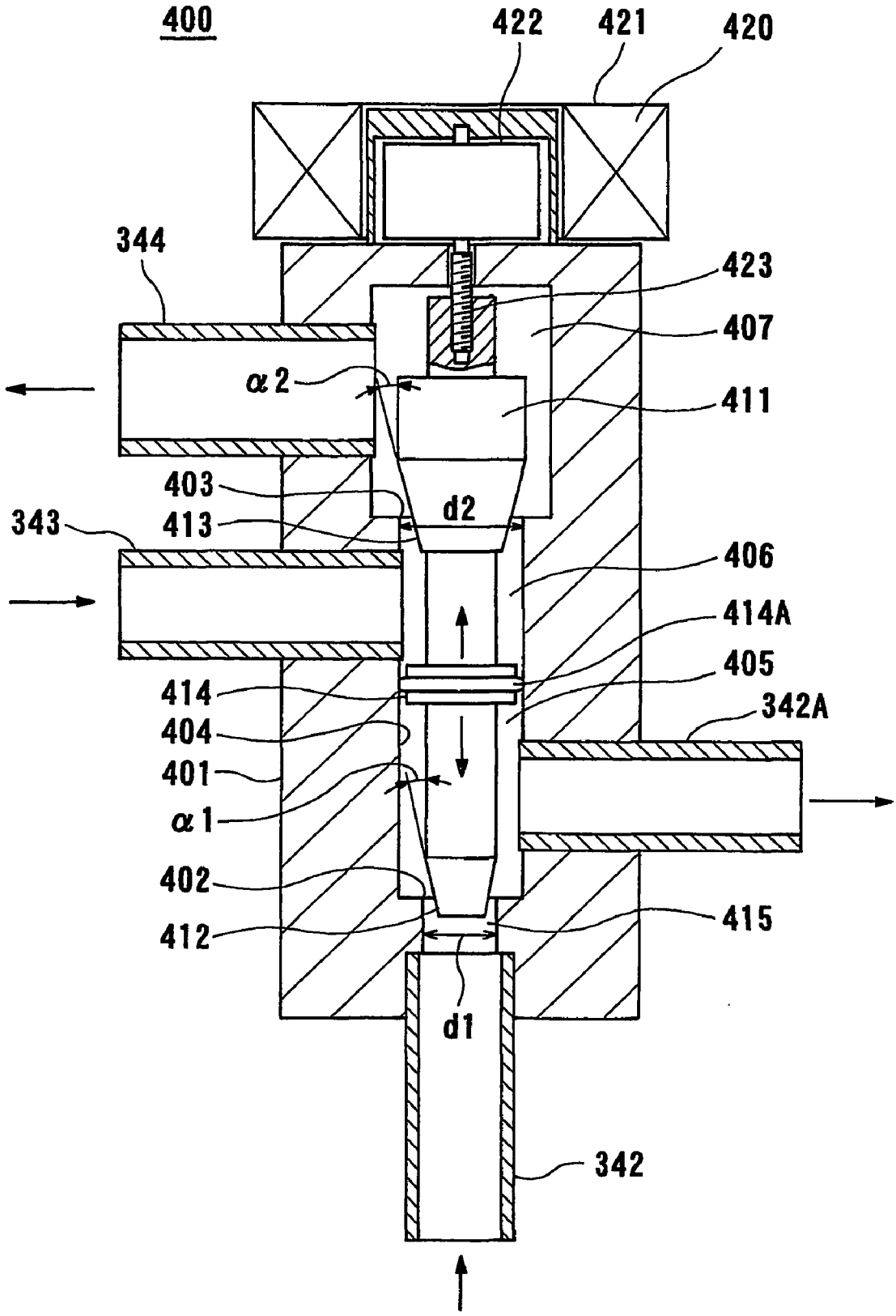
FIG. 13 is a cross-sectional view showing an integral expansion valve in the dehumidifying air-conditioning apparatus shown in FIG. 12.

A dehumidifying air-conditioning apparatus according to a fifth embodiment of the present invention will be described below with reference to FIGS. 12 and 13. FIG. 12 is a flow diagram of a dehumidifying air-conditioning apparatus according to the fifth embodiment of the present invention. In FIGS. 12 and 13, like parts and components are denoted by the same reference numerals and characters as those of the first embodiment and will not be described below.

The dehumidifying air-conditioning apparatus according to the fifth embodiment differs from the dehumidifying air-conditioning apparatus shown in FIG. 2 according to the first embodiment in that the orifices 11, 12 are replaced with an integral expansion valve 400 and the heat exchanger 2 is replaced with a heat exchanger 302. The heat exchanger 2 in the first embodiment may be used as a heat exchanger in the present embodiment. The dehumidifying air-conditioning apparatus includes a heat pump HP3 therein. The heat exchanger 302 has a first heat exchanging portion 321 for evaporating the refrigerant to cool the process air, and a second heat exchanging portion 322 for condensing the refrigerant to heat the process air.

Process air paths, which are paths for circulating process air, include a path 30 connecting the air-conditioned space 100 and the first heat exchanging portion 321 in the heat exchanger 302, a path 31 connecting the first heat exchanging portion 321 and the evaporator 1, a path 32 connecting the evaporator 1 and the second heat exchanging portion 322 in the heat exchanger 302, a path 33 connecting the second heat exchanging portion 322 and the air blower 3, and a path 34 connecting the air blower 3 and the air-conditioned space 100. Thus, the first heat exchanging portion 321 in the heat exchanger 302, the evaporator 1, and the second heat exchanging portion 322 in the heat exchanger 302 are connected in the order named by the process air paths.

Refrigerant paths, which are paths for circulating the refrigerant, include a path 40 connecting the evaporator 1 and the compressor 4, a path 41 connecting the compressor 4 and the condenser 5, a path 342 connecting the condenser 5 and the integral expansion valve 400, a path 342A connecting the integral expansion valve 400 and the heat exchanger 302, a path 343 connecting the heat exchanger 302 and the integral expansion valve 400, and a path 344 connecting the integral expansion valve 400 and the evaporator 1. The refrigerant path in the heat exchanger 302 extends through the first heat exchanging portion 321 repeatedly, and then extends through the second heat exchanging portion 322 repeatedly. An evaporating section 361 for evaporating the refrigerant to cool the process air which flows through the first heat exchanging portion 321 is provided in the first heat exchanging portion 321 of the heat exchanger 302. A condensing section 362 for condensing the refrigerant to heat (reheat) the process air which flows through the second heat exchanging portion 322 is provided in the second heat exchanging portion 322 of the heat exchanger 302.

The refrigerant flowing through the refrigerant path 342 is introduced through the integral expansion valve 400 into the refrigerant path 342A. The refrigerant path 342A is connected to the inlet of the evaporating section 361 in the first heat exchanging portion 321. The outlet of the evaporating section 361 is connected through a communicating pipe 342B to the inlet of the condensing section 362 in the second heat exchanging portion 322. The refrigerant path 343 is connected to the outlet of the condensing section 362 in the second heat exchanging portion 322. The refrigerant flowing through the refrigerant path 343 is introduced through the integral expansion valve 400 into the refrigerant path 344.

The first heat exchanging portion 321 has a meandering tube therein to form the evaporating section 361, and the tube extends through the first heat exchanging portion 321 a plurality of times. The second heat exchanging portion 322 also has a meandering tube to form the condensing section 362, and the tube extends through the second heat exchanging portion 322 a plurality of times. The tube in the first heat exchanging portion 311 is connected to the tube in the second heat exchanging portion 322 via the pipe 342B. Thus, the evaporating section 321 and the condensing section 322 are constructed as a continuous heat exchange tube. The heat exchange tube meanders to-and-fro through the first heat exchanging portion 361 a plurality of times (at least 1.5 times, typically at least 2 times) for evaporating the refrigerant flowing therethrough, and then meanders to-and-fro through the second heat exchanging portion 362 a plurality of times. Such an arrangement requires only one or a minimum number of pipes (2 to 4 pipes) connecting the evaporating section 361 and the condensing section 362, and hence it is easy to space the first heat exchanging portion 321 and the second heat exchanging portion 322.

In the present embodiment, the refrigerant is not so frequently evaporated and condensed in the evaporating section 361 and the condensing section 362 as in the first embodiment. Therefore, the refrigerant can sufficiently be evaporated in the evaporating section 361, and hence is prevented from being stagnated in the heat exchanger 302.

In the present embodiment, the dehumidifying air-conditioning apparatus comprises a controller 451, a pressure sensor 452 disposed on the path 40 for detecting the pressure in the refrigerant path 40 (i.e., the evaporating pressure of the evaporator 1 or the suction pressure of the compressor 4), and a temperature sensor 453 disposed on the path 40 for detecting the temperature in the refrigerant path 40 (i.e., the temperature of the refrigerant evaporated in the evaporator 1). The controller 451 controls the opening of the integral expansion valve 400 based on the pressure detected by the pressure sensor 452 and the temperature detected by the temperature sensor 453. The degree of superheat of the refrigerant in the refrigerant path 40, i.e., the degree of superheat of the refrigerant evaporated in the evaporator 1 is a function of the pressure and temperature of the refrigerant flowing through the refrigerant path 40. Therefore, the degree of superheat can be set to a desired value by controlling the flow rate of the refrigerant with the controller 451.

FIG. 13 is a cross-sectional view showing the integral expansion valve 400. As shown in FIG. 13, the integral expansion valve 400 comprises a valve body 401 having spindle housing chambers 405, 406, 407 defined therein, a spindle (valve element) 411 housed in the spindle housing chambers, and a stepping motor 420 mounted on an upper end of the valve body 401 for moving the spindle 411 in a direction of its axis. The stepping motor 420 has a stator 421 and a rotor 422, and the rotation axis of the rotor 422 is aligned with the axis of the spindle 411.

The valve body 401 is formed of a cylindrical or prismatic member having the cylindrical spindle housing chambers 405, 406, 407 defined therein. The axes of the cylindrical spindle housing chambers 405, 406, 407 are aligned with each other. The spindle housing chambers 405, 406 are formed as an integral chamber but separated from each other by a sealing portion 414A. The cylindrical spindle housing chamber 407 has an inside diameter larger than the spindle housing chambers 405, 406.

The spindle 411 has a lower portion having a valve portion 412 tapered at an angle (vertical angle) of á1, and an upper portion having a valve portion 413 tapered at an angle of á2. An introduction passage 415 is formed at the lower end of the valve body 401 for introducing the refrigerant from the refrigerant path 342 into the spindle housing chamber 405. The valve body 401 has a upper valve seat 403 located at the boundary between the spindle housing chambers 406 and 407, and a lower valve seat 402 located at the boundary between the spindle housing chamber 405 and the introduction passage 415. The upper valve portion 413 is brought into contact with the upper valve seat 403, and the lower valve portion 412 is brought into contact with the lower valve seat 402.

In the present embodiment, the diameter d1 of the lower valve seat 402 is smaller than the diameter d2 of the upper valve seat 403, and the angle á1 is equal to the angle á2.

The refrigerant path 342 is connected to the valve body 401 so at to introduce the refrigerant through the introduction passage 415 into the spindle housing chamber 405. Similarly, the refrigerant path 342A is connected to the valve body 401 so as to discharge the refrigerant from the spindle housing chamber 405, the refrigerant path 343 is connected to the valve body 401 so as to introduce the refrigerant into the spindle housing chamber 406, and the refrigerant path 344 is connected to the valve body 401 so as to discharge the refrigerant from the spindle housing chamber 407.

The sealing portion 414 is mounted at an intermediate position of the axis of the spindle 411, i.e., a cylindrical portion between the lower valve portion 412 and the upper valve portion 413. The sealing portion 414 has an outside diameter larger than the cylindrical portion of the spindle 411. The sealing portion 414 has a groove defined in an outer circumferential surface for an O-ring. An O-ring 414A is fitted into the groove in the sealing portion 414, so that the O-ring 414A serves as a sealing member.

An internal thread is formed at the upper end of spindle 411 in such a state that the axis of the internal thread is aligned with the axis of the spindle 411. An actuating screw 423 externally threaded is engaged with the internal thread. The actuating screw 423 is coupled to the shaft of the rotor 422 in the stepping motor 420.

With the integral expansion valve 400 thus constructed, when the stepping motor 420 is actuated, the actuating screw 423 is rotated to move the spindle 411 in the direction of its axis.

The spindle 411 is guided and supported by the actuating screw 423 and an inner surface 404 of the spindle housing chambers 405, 406. The amount of movement of the spindle 411 corresponds to the amount of rotation of the rotor 422. The controller 451 (see FIG. 12) transmits a signal to the stepping motor 420 to control the amount of rotation of the rotor 422. The opening areas of throttles at the lower valve portion 412 and the upper valve portion 413 are changed according to the amount of movement of the spindle 411. Since the lower valve portion 412 and the upper valve portion 413 are formed integrally with the spindle 411, the lower valve portion 412 and the upper valve portion 413 change the respective opening areas of their throttles in cooperation with each other. Specifically, the two valve portions 412, 413 produce the respective throttling effects in cooperation with each other. In other words, the two valve portions 412, 413 are formed integrally with each other and actuated by the stepping motor 420 as a single actuator.

In the present embodiment, the two valve portions 412, 413 have needle valve mechanisms. In the needle valve mechanisms, the diameter d1 of the lower valve seat 402 for the lower valve portion 412 is smaller than the diameter d2 of the upper valve seat 403 for the upper valve portion 413. Therefore, when the spindle 411 is moved in the direction of its axis, the lower valve portion 412 increases its opening area less than the upper valve portion 413. Specifically, the opening areas of the valve portions 412, 413 are changed in such a state that the throttling effect of the lower valve portion 412 as a first restriction is kept larger than the throttling effect of the upper valve portion 413 as a second restriction.

In the integral expansion valve 420, the pressure in the spindle housing chamber 405 corresponds the pressure of the evaporating section 361, and the pressure in the spindle housing chamber 406 corresponds the pressure of the condensing section 362. Thus, the pressures in the spindle housing chamber 406 is substantially the same as the that in the spindle housing chamber 407 (different only by loss of flow in the evaporating section 361 and the condensing section 362). Therefore, a sealing member having an extremely low sealing capability can be used as the sealing member 414A.

According to the present invention, with the integral expansion valve 400, the apparatus can be made compact. Since the valve portions produce the respective throttling effects in cooperation with each other, when the amount of the refrigerant circulated in the apparatus is adjusted, the amount of the refrigerant flowing into the heat exchanger 302 and the amount of the refrigerant flowing out of the heat exchanger 302 can be balanced so as not to stagnate the refrigerant in the heat exchanger 302, i.e., so as to keep the refrigerant in a suitable two-phase state in the heat exchanger 302.

In the above embodiment, the angle á1 is equal to the angle á2. However, the vertical angle á1 maybe smaller than the vertical angle á2. When the vertical angle á1 is smaller than the vertical angle á2, the diameter d1 may be equal to the diameter d2. Alternatively, when the vertical angle á1 is considerably smaller than the vertical angle á2, the diameter d1 maybe larger than the diameter d2. In this case, the positions of the valve portion 412 and the valve portion 413 shown in FIG. 13 may be replaced with each other. Any other arrangement can be applied to the present invention as long as the valve portion 412 as a first restriction increases its opening area less than the valve portion 413 as a second restriction when the valve portions 412, 413 are moved.

As described above, the evaporating section and the condensing section are constructed as a single row path, as shown in FIGS. 2 and 12, and a single integral expansion valve is disposed on the path. However, the present invention is not limited to these examples. As described with reference to FIG. 7, integral expansion valves may be disposed on a plurality of refrigerant paths 142, 143, 144 branched at the downstream side of the condenser 5. Further, when the branched refrigerant paths 142, 143, 144 extend to the interior of the evaporator 1 and are joined to each other at the downstream side of the evaporator 1, integral expansion valves may be disposed on the respective branched refrigerant paths.

Figure 14:
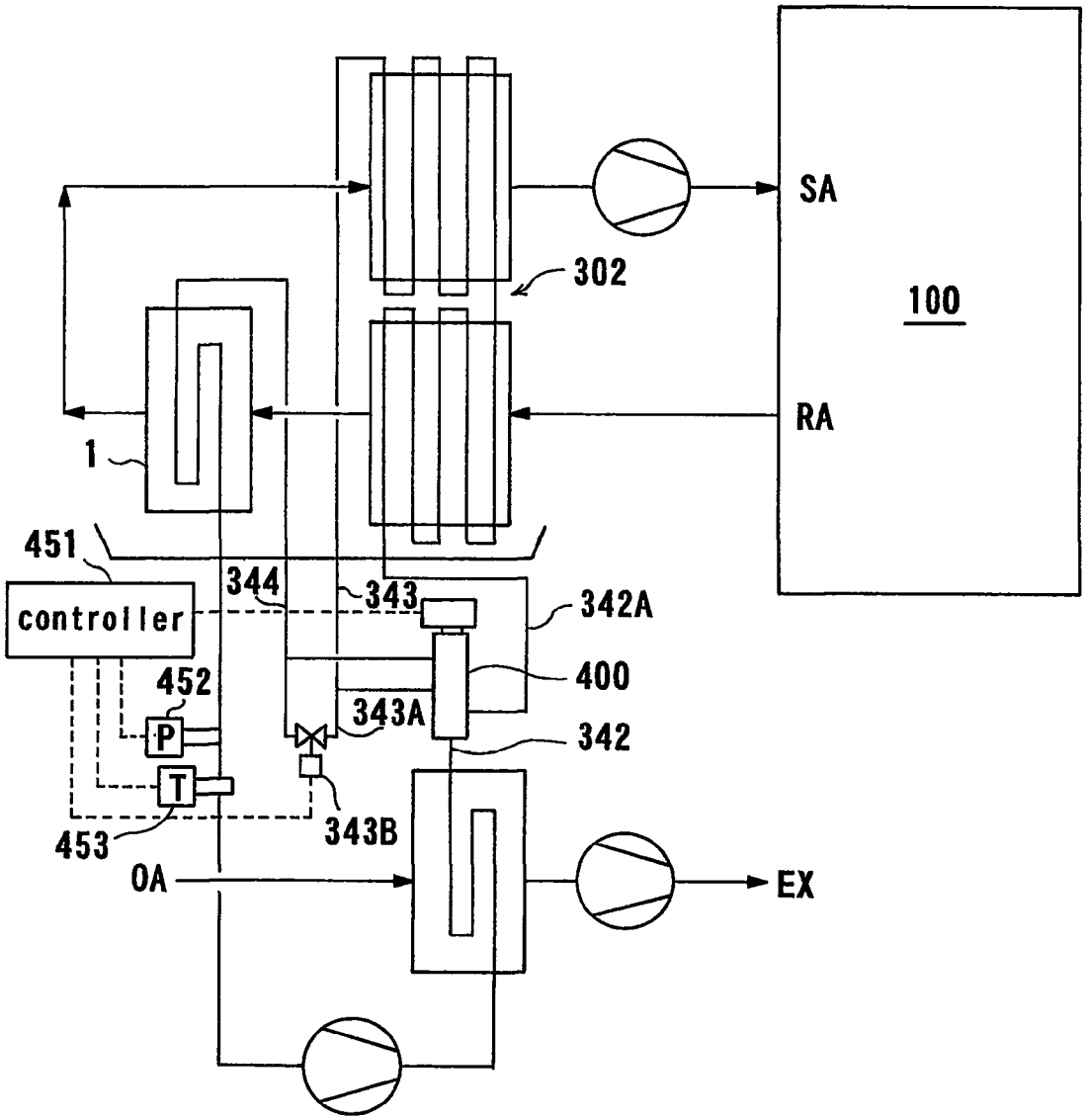
FIG. 14 is a flow diagram of a dehumidifying air-conditioning apparatus according to a sixth embodiment of the present invention.
Figure 15:
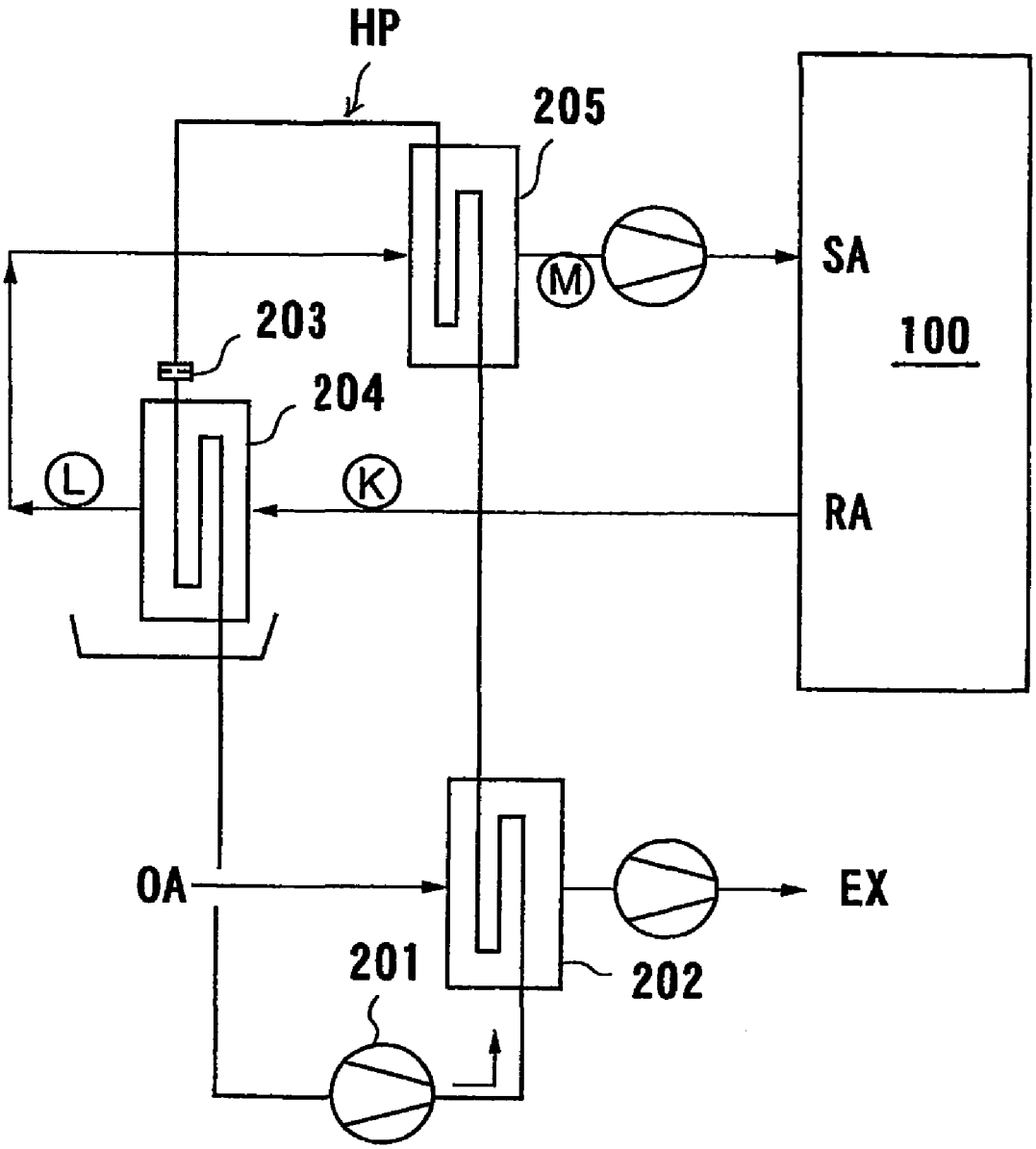
FIG. 15 is a flow diagram of a conventional dehumidifying air-conditioning apparatus.
Figure 16:
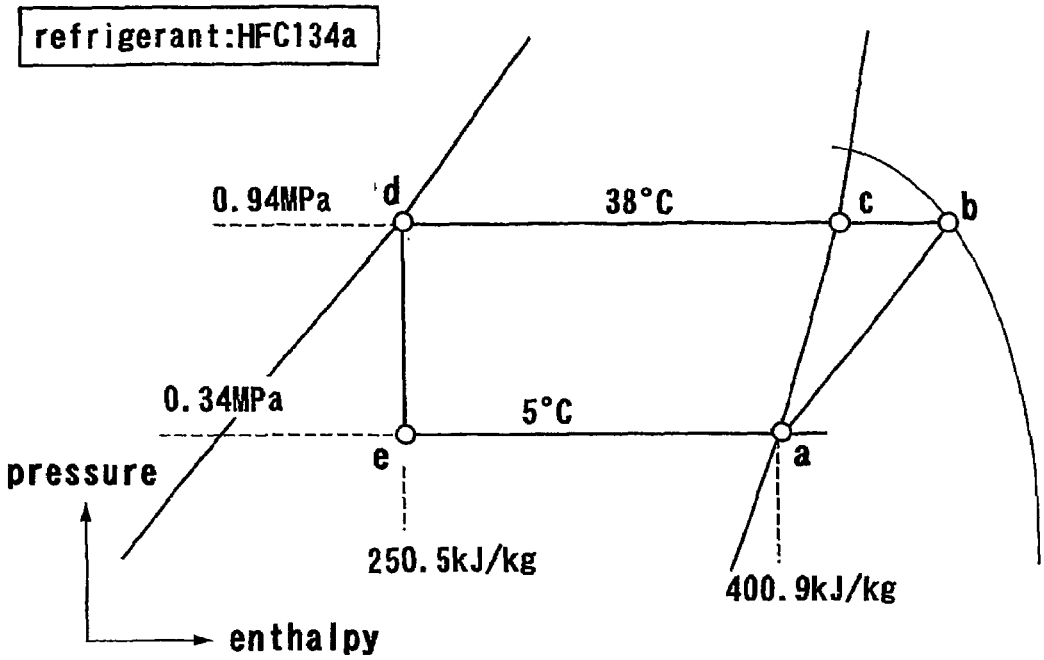
FIG. 16 is a Mollier diagram of a heat pump included in the conventional dehumidifying air-conditioning apparatus.
Figure 17:
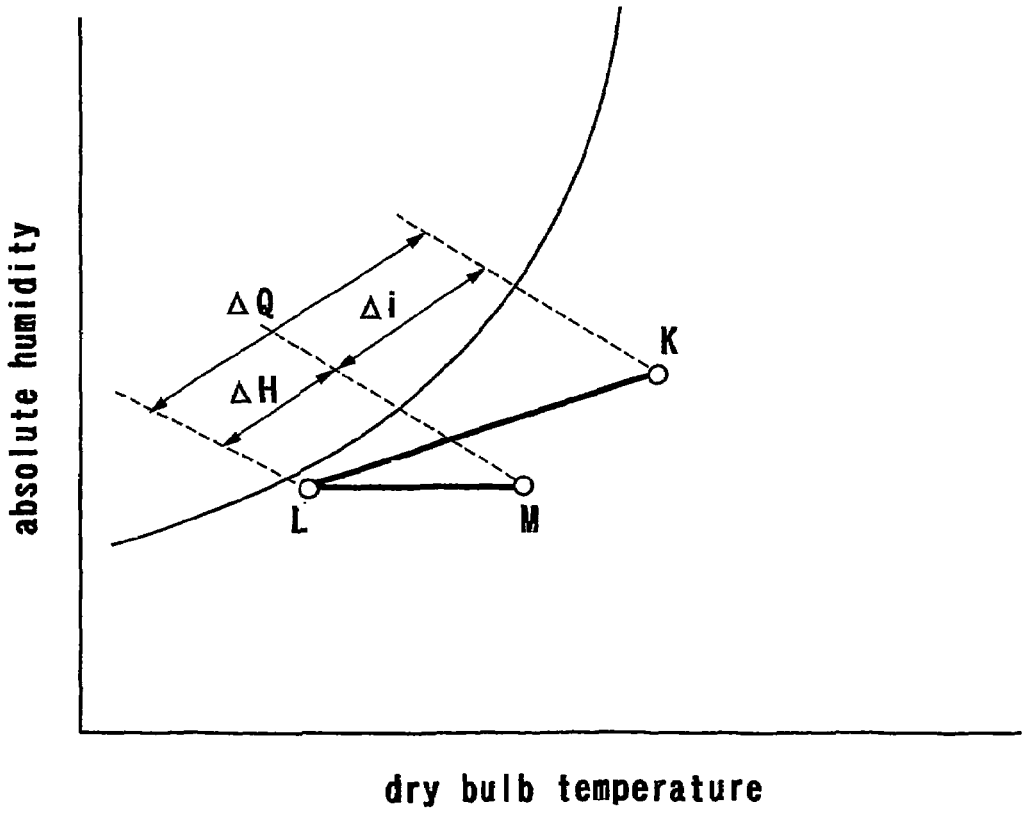
FIG. 17 is a psychrometric chart showing an air-conditioning cycle in the conventional dehumidifying air-conditioning apparatus.

A dehumidifying air-conditioning apparatus according to a sixth embodiment of the present invention will be described below with reference to FIG. 14. FIG. 14 is a flow diagram of a dehumidifying air-conditioning apparatus according to the sixth embodiment of the present invention. In FIG. 14, most of like parts and components of the fifth embodiment are not denoted by the reference numerals, and will not be described below.

The dehumidifying air-conditioning apparatus in the present embodiment differs from the fifth embodiment in that a bypass refrigerant path 343A is provided between the refrigerant path 343 and the refrigerant path 344. A solenoid valve 343B is disposed as a bypass valve on the bypass refrigerant path 343A. The solenoid valve 343B is connected to the controller 451 via a signal circuit and controlled by a signal from the controller 451.

When the solenoid valve 343B is opened, the refrigerant bypasses the valve portion 413 (see FIG. 13). In this state, the valve portion 413 produces no throttling effect. Specifically, the valve portion 413 does not substantially serve as a throttle. In this case, the valve portion 412 serves as a throttle, and the refrigerant is evaporated in the heat exchanger under substantially the same pressure as in the evaporator 1. Specifically, the dehumidifying air-conditioning apparatus serves as a cooling air-conditioning apparatus.

Based on a signal from a humidity sensor (not shown) for detecting the humidity of the process air in the air-conditioned space 100 (and a temperature sensor for detecting the temperature of the process air in the air-conditioned space 100), the controller 451 determines which should be selected: a dehumidifying operation mode or a cooling operation mode. Then, the controller 451 transmits a signal to the solenoid valve 343B according to the determined result. Specifically, when the humidity is high and the temperature (air temperature) is relatively low, the dehumidifying operation mode is selected and the solenoid valve 343B is closed. When the air temperature is high, the cooling operation mode is selected and the solenoid valve 343B is opened. The modes of the dehumidifying operation and the cooling operation may manually be selected without the controller.

While the present invention has been described in detail with reference to the preferred embodiments thereof, it would be apparent to those skilled in the art that many modifications and variations may be made therein without departing from the spirit and scope of the present invention.

INDUSTRIAL APPLICABILITY

The present invention is suitable for use in a dehumidifying air-conditioning apparatus which has a heat pump with a high coefficient of performance (COP) and a high moisture removal per energy consumption.

The invention claimed is:

1. A dehumidifying air-conditioning apparatus comprising:

a pressurizer for raising a pressure of a refrigerant;

a condenser for condensing said refrigerant to heat a high-temperature heat source fluid;

an evaporator for evaporating said refrigerant to cool process air to a temperature lower than its dew point;

a first heat exchanging portion disposed in a refrigerant path between said condenser and said evaporator for evaporating said refrigerant under an intermediate pressure between the condensing pressure of said condenser and the evaporating pressure of said evaporator to cool said process air by evaporation of said refrigerant under said intermediate pressure;

a second heat exchanging portion disposed in said refrigerant path between said condenser and said evaporator for condensing said refrigerant under an intermediate pressure between the condensing pressure of said condenser and the evaporating pressure of said evaporator to heat said process air by condensation of said refrigerant under said intermediate pressure;

a process air path connecting said first heat exchanging portion, said evaporator, and said second heat exchanging portion in the order named;

a first restriction disposed on said refrigerant path at the upstream side of said first heat exchanging portion; and a second restriction disposed on said refrigerant path at the downstream side of said second heat exchanging portion;

wherein the throttling effect of said first restriction is larger than that of said second restriction.

2. A dehumidifying air-conditioning apparatus according to claim 1, wherein at least one of said first restriction and said second restriction comprises an orifice.

3. A dehumidifying air-conditioning apparatus according to claim 1, wherein at least one of said first restriction and said second restriction comprises a capillary tube.

4. A dehumidifying air-conditioning apparatus according to claim 1, wherein at least one of said first restriction and said second restriction comprises an expansion valve.

5. A dehumidifying air-conditioning apparatus according to claim 1, wherein said first restriction and said second restriction produce respective throttling effects in cooperation with each other.

6. A dehumidifying air-conditioning apparatus according to claim 5, wherein said first restriction and said second restriction are formed integrally with each other and actuated by a single actuator.

7. A dehumidifying air-conditioning apparatus according to claim 6, wherein said first restriction and said second restriction have needle valve mechanisms.

8. A dehumidifying air-conditioning apparatus comprising:

a pressurizer for raising a pressure of a refrigerant;

a condenser for condensing said refrigerant to heat a high-temperature heat source fluid;

an evaporator for evaporating said refrigerant to cool process air to a temperature lower than its dew point;

a refrigerant path branched into a plurality of branched refrigerant paths between said condenser and said evaporator;

a first heat exchanging portion disposed in said branched refrigerant path between said condenser and said evaporator for evaporating said refrigerant under an intermediate pressure between the condensing pressure of said condenser and the evaporating pressure of said evaporator to cool said process air by evaporation of said refrigerant under said intermediate pressure;

a second heat exchanging portion disposed in said branched refrigerant path between said condenser and said evaporator for condensing said refrigerant under an intermediate pressure between the condensing pressure of said condenser and the evaporating pressure of said evaporator to heat said process air by condensation of said refrigerant under said intermediate pressure;

a process air path connecting said first heat exchanging portion, said evaporator, and said second heat exchanging portion in the order named;

a first restriction disposed on said refrigerant path at the upstream side of said first heat exchanging portion; and a second restriction disposed on said refrigerant path at the downstream side of said second heat exchanging portion;

wherein the throttling effect of said first restriction is larger than that of said second restriction.

9. A dehumidifying air-conditioning apparatus according to claim 8, wherein at least one of said first restriction and said second restriction comprises an orifice.

10. A dehumidifying air-conditioning apparatus according to claim 8, wherein at least one of said first restriction and said second restriction comprises a capillary tube.

11. A dehumidifying air-conditioning apparatus according to claim 8, wherein at least one of said first restriction and said second restriction comprises an expansion valve.

12. A dehumidifying air-conditioning apparatus according to claim 8, wherein said first restriction and said second restriction produce respective throttling effects in cooperation with each other.

13. A dehumidifying air-conditioning apparatus according to claim 12, wherein said first restriction and said second restriction are formed integrally with each other and actuated by a single actuator.

14. A dehumidifying air-conditioning apparatus according to claim 13, wherein said first restriction and said second restriction have needle valve mechanisms.

15. A dehumidifying air-conditioning apparatus comprising:

a pressurizer for raising a pressure of a refrigerant;

a condenser for condensing said refrigerant to heat a high-temperature heat source fluid;

an evaporator for evaporating said refrigerant to cool process air to a temperature lower than its dew point;

a first heat exchanging portion disposed in a refrigerant path between said condenser and said evaporator for evaporating said refrigerant under an intermediate pressure between the condensing pressure of said condenser and the evaporating pressure of said evaporator to cool said process air by evaporation of said refrigerant under said intermediate pressure;

a second heat exchanging portion disposed in said refrigerant path between said condenser and said evaporator for condensing said refrigerant under an intermediate pressure between the condensing pressure of said condenser and the evaporating pressure of said evaporator to heat said process air by condensation of said refrigerant under said intermediate pressure;

a process air path connecting said first heat exchanging portion, said evaporator, and said second heat exchanging portion in the order named;

a first restriction disposed on said refrigerant path at the upstream side of said first heat exchanging portion; and a second restriction disposed on said refrigerant path at the downstream side of said second heat exchanging portion;

wherein the quality at the upstream side of said first restriction is smaller than the quality at the upstream side of said second restriction.

16. A dehumidifying air-conditioning apparatus according to claim 15, wherein said first restriction and said second restriction produce respective throttling effects in cooperation with each other.

17. A dehumidifying air-conditioning apparatus according to claim 16, wherein said first restriction and said second restriction are formed integrally with each other and actuated by a single actuator.

18. A dehumidifying air-conditioning apparatus according to claim 17, wherein said first restriction and said second restriction have needle valve mechanisms.

* * * * *